US009291934B2

(12) United States Patent
Shimizu et al.

(10) Patent No.: US 9,291,934 B2
(45) Date of Patent: Mar. 22, 2016

(54) IMAGE FORMING APPARATUS

(71) Applicants: Yasunobu Shimizu, Kanagawa (JP); Hiromi Ogiyama, Tokyo (JP); Hirokazu Ishii, Kanagawa (JP); Shinya Tanaka, Kanagawa (JP); Keigo Nakamura, Kanagawa (JP)

(72) Inventors: Yasunobu Shimizu, Kanagawa (JP); Hiromi Ogiyama, Tokyo (JP); Hirokazu Ishii, Kanagawa (JP); Shinya Tanaka, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/666,474

(22) Filed: Nov. 1, 2012

(65) Prior Publication Data

US 2013/0136468 A1 May 30, 2013

(30) Foreign Application Priority Data

Nov. 28, 2011 (JP) ..... 2011-258702
Apr. 6, 2012 (JP) ..... 2012-087241
Aug. 13, 2012 (JP) ..... 2012-179267

(51) Int. Cl.
*G03G 15/16* (2006.01)
*G03G 15/01* (2006.01)

(52) U.S. Cl.
CPC ..... *G03G 15/0189* (2013.01); *G03G 15/1605* (2013.01); *G03G 15/1675* (2013.01)

(58) Field of Classification Search
CPC ..... G03G 15/1675
USPC ..... 399/45, 46, 44, 66
See application file for complete search history.

(56) References Cited

U.S. PATENT DOCUMENTS 5,483,330 A 1/1996 Ogiyama et al.
5,515,146 A 5/1996 Harasawa et al.
5,631,725 A 5/1997 Harasawa et al.
5,812,919 A 9/1998 Takano et al.

(Continued)

FOREIGN PATENT DOCUMENTS

JP 2-300774 12/1990
JP 4-086878 3/1992

(Continued)

OTHER PUBLICATIONS

U.S. Appl. No. 13/477,724, filed May 22, 2012, Yasunobu Shimizu, et al.

(Continued)

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P

(57) ABSTRACT

An image forming apparatus includes an image bearing member to bear a toner image on a surface thereof, a transfer device to transfer the toner image onto a recording medium, and a transfer bias power source to apply to the transfer device a superimposed transfer bias in which an alternating current (AC) component is superimposed on a direct current (DC) component in a superimposed transfer mode to transfer the toner image. The superimposed transfer bias has a waveform in which a first polarity in a direction of transferring the toner image onto the recording medium and a second polarity opposite the first polarity switch alternately. The superimposed transfer bias is output such that a standard value of each of the DC component and the AC component is multiplied by a respective correction ratio, and the correction ratio of the DC component is different from that of the AC component.

29 Claims, 27 Drawing Sheets

(56) References Cited

U.S. PATENT DOCUMENTS

| | | | | |
|---|---|---|---|---|
| 5,822,667 | A | 10/1998 | Hayama et al. | |
| 5,930,573 | A | 7/1999 | Miyamoto et al. | |
| 6,188,862 | B1 | 2/2001 | Ishii | |
| 6,282,386 | B1 | 8/2001 | Ishii | |
| 7,062,184 | B2 * | 6/2006 | Ohtani et al. | 399/45 |
| 2002/0034406 | A1 | 3/2002 | Kawagoe et al. | |
| 2003/0026625 | A1 | 2/2003 | Tamiya et al. | |
| 2003/0035658 | A1 | 2/2003 | Ishii | |
| 2003/0118359 | A1 | 6/2003 | Ogiyama et al. | |
| 2003/0219287 | A1 | 11/2003 | Ogiyama et al. | |
| 2003/0219296 | A1 | 11/2003 | Kabata et al. | |
| 2004/0105692 | A1 | 6/2004 | Tamiya et al. | |
| 2004/0136760 | A1 | 7/2004 | Yoshida et al. | |
| 2005/0180767 | A1 | 8/2005 | Ishii et al. | |
| 2006/0239722 | A1 | 10/2006 | Tanaka et al. | |
| 2007/0003333 | A1 | 1/2007 | Ishii | |
| 2007/0014597 | A1 | 1/2007 | Ishii | |
| 2007/0127941 | A1 | 6/2007 | Ishii et al. | |
| 2007/0258737 | A1 | 11/2007 | Ogiyama et al. | |
| 2008/0088883 | A1 | 4/2008 | Yoshida | |
| 2010/0008687 | A1 | 1/2010 | Ishii | |
| 2010/0329707 | A1 * | 12/2010 | Yamada | 399/44 |
| 2011/0229168 | A1 | 9/2011 | Shiraishi et al. | |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0063809 | A1 | 3/2012 | Tanaka et al. | |
| 2012/0170951 | A1 | 7/2012 | Ishii | |
| 2012/0230715 | A1 * | 9/2012 | Ogino et al. | 399/66 |
| 2012/0237234 | A1 | 9/2012 | Sugimoto et al. | |
| 2012/0237271 | A1 | 9/2012 | Sengoku et al. | |
| 2012/0243892 | A1 | 9/2012 | Nakamura et al. | |

FOREIGN PATENT DOCUMENTS

| | | |
|---|---|---|
| JP | 9-146381 | 6/1997 |
| JP | 2000-330401 | 11/2000 |
| JP | 2005-31443 | 2/2005 |
| JP | 2006-267486 | 10/2006 |
| JP | 2008-058585 | 3/2008 |
| JP | 2008-096687 | 4/2008 |
| JP | 2011-191579 | 9/2011 |

OTHER PUBLICATIONS

U.S. Appl. No. 13/485,151, filed May 31, 2012, Yasunobu Shimizu, et al.
U.S. Appl. No. 13/483,536, filed May 30, 2012, Kenji Sengoku, et al.
U.S. Appl. No. 13/530,555, filed Jun. 22, 2012, Tomokazu Takeuchi, et al.
U.S. Appl. No. 13/526,894, filed Jun. 19, 2012, Tomokazu Takeuchi, et al.
U.S. Appl. No. 13/472,743, filed May 16, 2012, Junpei Fujita, et al.
U.S. Appl. No. 13/527,153, filed Jun. 19, 2012, Junpei Fujita, et al.
U.S. Appl. No. 13/525,681, filed Jun. 18, 2012, Naomi Sugimoto, et al.
U.S. Appl. No. 13/472,897, filed May 16, 2012, Hiromi Ogiyama.
U.S. Appl. No. 13/541,211, filed Jul. 3, 2012, Hiromi Ogiyama, et al.
U.S. Appl. No. 13/602,840, filed Sep. 4, 2012, Nakamura, et al.
U.S. Appl. No. 13/646,898, filed Oct. 8, 2012, Mimbu, et al.
Japanese Office Action issued Nov. 11, 2014, in Japan Patent Application No. 2012-179267.

* cited by examiner

DC BIAS APPLICATION

SUPERIMPOSED BIAS APPLICATION (EXAMPLE 1)

FIG. 8

EFFECT OF EXAMPLES 1 AND 2

TRAPEZOID WAVE – TRAPEZOID WAVE, MODIFIED RETURN TIME 40%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | | | |
| −6.8 | | | | | | |
| −6.6 | | | | | | |
| −6.4 | | | | | | |
| −6.2 | × | × | × | × | | |
| −6.0 | × | × | △ | × | | |
| −5.8 | × | △ | ○ | × | | |
| −5.6 | △ | △ | ○ | △ | × | |
| −5.4 | △ | ○ | ○ | △ | △ | × |
| −5.2 | ○ | ○ | ○ | △ | △ | × |
| −5.0 | △ | ○ | ○ | ○ | △ | × |
| −4.8 | △ | ○ | ○ | ○ | △ | × |
| −4.6 | △ | ○ | ○ | ○ | △ | × |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR (EXAMPLE 2)

(EXAMPLE 3)

(EXAMPLE 4)

FIG. 12

EFFECT OF EXAMPLE 4

TRAPEZOID WAVE – TRAPEZOID WAVE
RETURN TIME 45%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | | | |
| −6.8 | | | | | | |
| −6.6 | | | | | | |
| −6.4 | | | | | | |
| −6.2 | | | | | | |
| −6.0 | | | × | | | |
| −5.8 | | | × | × | | |
| [illegible] | × | × | △ | × | × | |
| [illegible] | × | △ | ○ | △ | △ | |
| −5.2 | × | ○ | ○ | △ | △ | |
| −5.0 | × | ○ | ○ | ○ | △ | × |
| −4.8 | △ | ○ | ○ | ○ | △ | × |
| −4.6 | △ | ○ | ○ | ○ | ○ | × |
| −4.4 | × | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR (EXAMPLE 5)

FIG. 14

EFFECT OF EXAMPLE 5

TRAPEZOID WAVE – TRAPEZOID WAVE
RETURN TIME 40%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | | | |
| −6.8 | | | | | | |
| −6.6 | | | | | | |
| −6.4 | | | | | | |
| −6.2 | × | × | × | × | | |
| −6.0 | × | × | △ | × | | |
| −5.8 | × | △ | ○ | × | | |
| −5.6 | △ | ○ | ○ | △ | × | |
| −5.4 | △ | ○ | ○ | △ | △ | × |
| −5.2 | ○ | ○ | ○ | ○ | △ | × |
| −5.0 | △ | ○ | ○ | ○ | △ | × |
| −4.8 | △ | ○ | ○ | ○ | △ | × |
| −4.6 | △ | ○ | ○ | ○ | ○ | × |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR (EXAMPLE 6)

FIG. 16

EFFECT OF EXAMPLE 6

TRIANGLE WAVE – TRAPEZOID WAVE
RETURN TIME 32%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | | | |
| −6.8 | | × | × | × | | |
| −6.6 | × | × | △ | × | × | |
| −6.4 | × | × | △ | △ | × | |
| −6.2 | × | △ | ○ | ○ | × | × |
| −6.0 | △ | ○ | ○ | ○ | △ | × |
| −5.8 | △ | ○ | ○ | ○ | △ | × |
| −5.6 | △ | ○ | ○ | ○ | △ | × |
| −5.4 | ○ | ○ | ○ | ○ | △ | × |
| −5.2 | ○ | ○ | ○ | ○ | ○ | × |
| −5.0 | △ | ○ | ○ | ○ | ○ | × |
| −4.8 | △ | ○ | ○ | ○ | ○ | △ |
| −4.6 | △ | ○ | ○ | ○ | ○ | △ |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR (EXAMPLE 7)

FIG. 18

EFFECT OF EXAMPLE 7

TRIANGLE WAVE – TRAPEZOID WAVE
RETURN TIME 16%

| Vave \ Vpp | 8 | 10 | 12 | 14 | 16 | 18 |
|---|---|---|---|---|---|---|
| −7.6 | | | | | | |
| −7.4 | | | × | × | | |
| −7.2 | | × | △ | △ | | |
| −7.0 | | × | △ | ○ | | |
| [illegible] | | △ | ○ | ○ | | |
| [illegible] | × | △ | ○ | ○ | × | |
| −6.4 | △ | ○ | ○ | ○ | × | |
| −6.2 | △ | ○ | ○ | ○ | × | × |
| −6.0 | ○ | ○ | ○ | ○ | △ | × |
| −5.8 | ○ | ○ | ○ | ○ | △ | × |
| −5.6 | ○ | ○ | ○ | ○ | △ | × |
| −5.4 | ○ | ○ | ○ | ○ | ○ | × |
| −5.2 | ○ | ○ | ○ | ○ | ○ | △ |
| −5.0 | △ | ○ | ○ | ○ | ○ | △ |
| −4.8 | △ | ○ | ○ | ○ | ○ | △ |
| −4.6 | △ | ○ | ○ | ○ | ○ | △ |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR (EXAMPLES 8 AND 9)

FIG. 20

EFFECT OF EXAMPLE 8

TRIANGLE WAVE – TRAPEZOID WAVE
RETURN TIME 8%

| Vave \ Vpp | 8 | 10 | 12 | 14 | 16 | 18 |
|---|---|---|---|---|---|---|
| −7.6 | | | | △ | | |
| −7.4 | | | × | △ | | |
| [illegible] | | × | △ | ○ | | |
| [illegible] | | × | ○ | ○ | | |
| −6.8 | | △ | ○ | ○ | × | |
| −6.6 | × | △ | ○ | ○ | × | |
| −6.4 | △ | ○ | ○ | ○ | △ | |
| −6.2 | △ | ○ | ○ | ○ | △ | × |
| −6.0 | ○ | ○ | ○ | ○ | △ | × |
| −5.8 | ○ | ○ | ○ | ○ | ○ | △ |
| −5.6 | ○ | ○ | ○ | ○ | ○ | △ |
| −5.4 | ○ | ○ | ○ | ○ | ○ | △ |
| −5.2 | ○ | ○ | ○ | ○ | ○ | △ |
| −5.0 | △ | ○ | ○ | ○ | ○ | △ |
| −4.8 | △ | ○ | ○ | ○ | ○ | △ |
| −4.6 | △ | ○ | ○ | ○ | ○ | △ |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR

FIG. 21

EFFECT OF EXAMPLE 9

TRIANGLE WAVE - TRAPEZOID WAVE
RETURN TIME 4%

| Vave \ Vpp | 8 | 10 | 12 | 14 | 16 | 18 |
|---|---|---|---|---|---|---|
| -7.6 | | | | | | |
| -7.4 | | | | | | |
| -7.2 | | | | | | |
| -7.0 | | | | | | |
| -6.8 | | | | | | |
| -6.6 | | | × | × | | |
| -6.4 | | | × | △ | | |
| -6.2 | | | × | △ | × | |
| -6.0 | | | △ | ○ | △ | |
| [illegible] | | × | △ | ○ | △ | |
| [illegible] | | × | ○ | ○ | △ | × |
| -5.4 | | △ | ○ | ○ | ○ | × |
| -5.2 | | △ | ○ | ○ | ○ | △ |
| -5.0 | × | ○ | ○ | ○ | ○ | △ |
| -4.8 | △ | ○ | ○ | ○ | ○ | △ |
| -4.6 | △ | ○ | ○ | ○ | ○ | △ |
| -4.4 | △ | △ | △ | △ | △ | × |
| -4.2 | × | × | × | × | × | × |
| -4.0 | | | | | | |

WHITE SPOTS

POOR TRANSFER AT RECESSED PORTION

POOR TRANSFER AT PROJECTION

○: GOOD
△: FAIR
×: POOR (EXAMPLE 10)

FIG. 23

EFFECT OF EXAMPLE 10

TRIANGLE WAVE - TRAPEZOID WAVE, ROUNDED
RETURN TIME 16%

| Vave \ Vpp | 8 | 10 | 12 | 14 | 16 | 18 |
|---|---|---|---|---|---|---|
| −7.6 | | | | | | |
| −7.4 | | | | | | |
| −7.2 | | | | | | |
| −7.0 | | | | × | | |
| −6.8 | | × | × | △ | | |
| −6.6 | × | × | △ | △ | × | |
| −6.4 | × | × | △ | ○ | × | |
| −6.2 | × | △ | ○ | ○ | × | |
| −6.0 | △ | ○ | ○ | ○ | × | |
| −5.8 | △ | ○ | ○ | ○ | △ | × |
| −5.6 | ○ | ○ | ○ | ○ | △ | × |
| −5.4 | ○ | ○ | ○ | ○ | △ | × |
| −5.2 | ○ | ○ | ○ | ○ | ○ | × |
| −5.0 | △ | ○ | ○ | ○ | ○ | × |
| −4.8 | △ | ○ | ○ | ○ | ○ | △ |
| −4.6 | △ | ○ | ○ | ○ | ○ | △ |
| −4.4 | △ | △ | △ | △ | △ | × |
| −4.2 | × | × | × | × | × | × |
| −4.0 | | | | | | |

POOR TRANSFER AT RECESSED PORTION

WHITE SPOTS

POOR TRANSFER AT PROJECTION

○: GOOD
△: FAIR
×: POOR

IMAGE FORMING APPARATUS

CROSS-REFERENCE TO RELATED APPLICATIONS

This patent application is based on and claims priority pursuant to 35 U.S.C. §119 to Japanese Patent Applications Nos. 2011-258702, filed on Nov. 28, 2011, 2012-087241, filed on Apr. 6, 2012, and 2012-179267 filed on Aug. 13, 2012 in the Japan Patent Office, which are hereby incorporated herein by reference in their entirety.

BACKGROUND OF THE INVENTION

1. Field of the Invention

Exemplary aspects of the present invention generally relate to an electrophotographic image forming apparatus, such as a copier, a facsimile machine, a printer, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In known image forming apparatuses using an electrophotographic method, a transfer bias, for example, a direct current (DC) transfer bias under constant current control, is applied to the transfer device using a DC power source. Generally, under the constant-current control, an output voltage in a bias application circuit is detected by a detection circuit provided to the bias application circuit, and a resistance at a transfer roller side (a resistance including an image bearing member and a recording medium, for example), is calculated based on the detected output voltage. Based on the obtained resistance, a transfer current value is determined and adjusted (corrected). Alternatively, ambient temperature and humidity are detected, and the transfer current value is determined and adjusted based on the detected temperature and the humidity.

In recent years, a variety of recording media sheets such as paper having a luxurious, leather-like texture and Japanese paper known as "Washi" have come on the market. Such recording media sheets have a coarse surface through embossing process to produce that luxurious impression. However, toner does not transfer well to such embossed surfaces, in particular, the recessed portions of the surface. This inadequate transfer of the toner appears as dropouts or white spots in the resulting output image.

Various attempts have been made to prevent improper transfer of the toner under such circumstances. For example, a superimposed bias, in which an alternating current (AC) voltage is superimposed on a direct current (DC) voltage, is supplied as a secondary transfer bias to enhance transferability.

In such a configuration, the AC component affects transfer of toner to the recessed portions of the recording medium, and the DC component affects transfer of toner to the projecting portions of the recording medium. Although advantageous and generally effective for its intended purpose, if the same amount of transfer bias correction is applied to the DC component and the AC component, one of the DC component and the AC component is not corrected sufficiently, resulting in an image defect, such as unevenness of image density, or one of the DC component and the AC component is corrected excessively, causing electric discharge and thus white spots (partial absence of toner) in a resulting image In view of the above, there is thus an unsolved need for an image forming apparatus capable of maintaining good transferability regardless of surface conditions of recording media.

SUMMARY OF THE INVENTION

In view of the foregoing, in an aspect of this disclosure, there is provided an improved image forming apparatus including an image bearing member, a transfer device, and a transfer bias power source. The image bearing member bears a toner image on a surface thereof. The transfer device transfers the toner image onto a recording medium. The transfer bias power source applies to the transfer device a superimposed transfer bias in which an alternating current (AC) component is superimposed on a direct current (DC) component in a superimposed transfer mode to transfer the toner image. The superimposed transfer bias has a waveform in which a first polarity in a direction of transferring the toner image onto the recording medium and a second polarity opposite the first polarity switch alternately. The superimposed transfer bias is output such that a standard value of each of the DC component and the AC component is multiplied by a respective correction ratio, and the correction ratio of the DC component is different from that of the AC component.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 8 is a table showing an effect of the waveform shown in FIG. 7;

FIG. 12 is a table showing an effect of the waveform shown in FIG. 11;

FIG. 14 is a table showing an effect of the waveform shown in FIG. 13;

FIG. 16 is a table showing an effect of the waveform shown in FIG. 15;

FIG. 18 is a table showing an effect of the waveform shown in FIG. 17;

FIG. 20 is a table showing an effect of the eighth example;

FIG. 21 is a table showing an effect of the ninth example;

FIG. 23 is a table showing an effect of the waveform shown in FIG. 22;

DETAILED DESCRIPTION OF THE INVENTION

Figure 1:
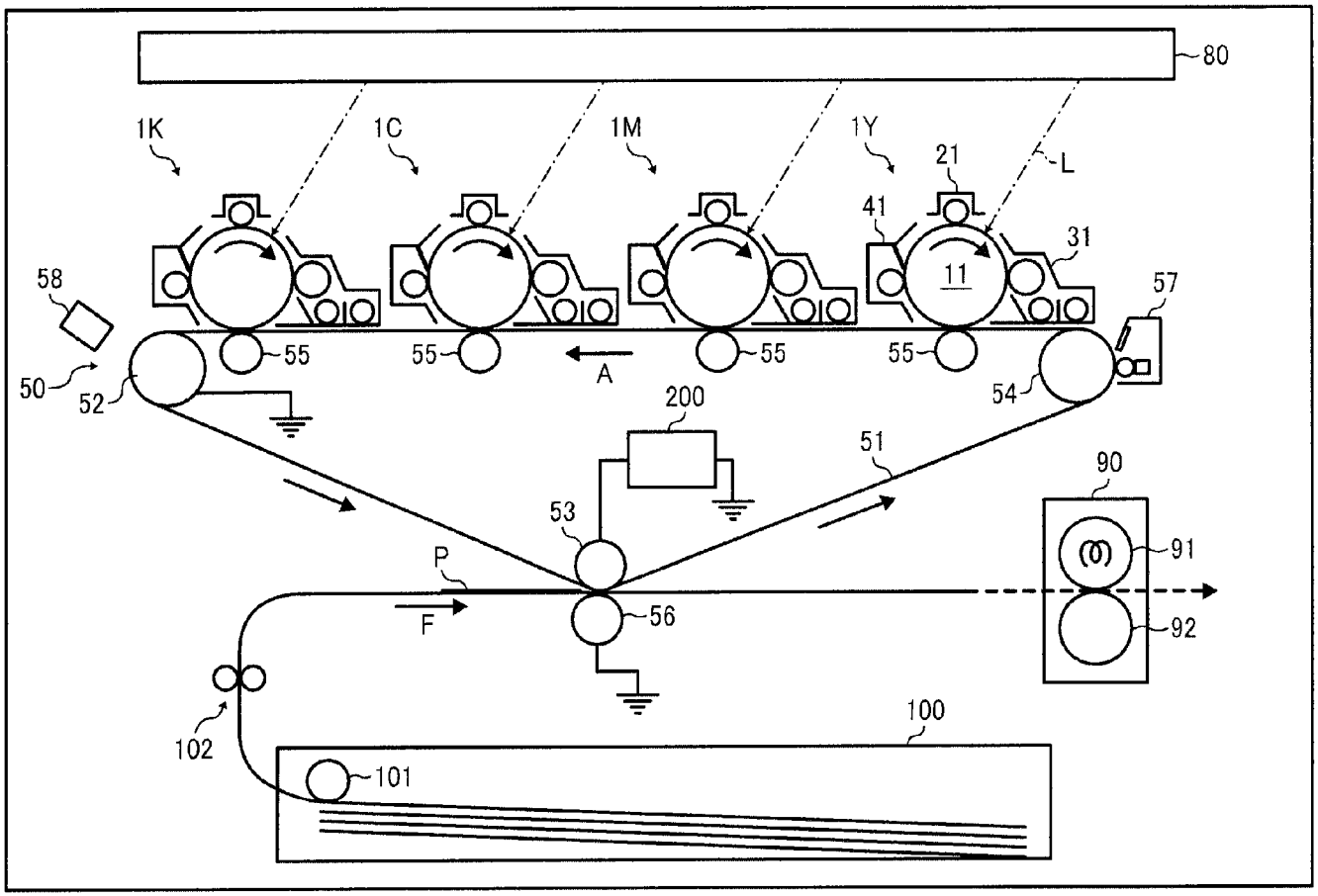
FIG. 1 is a cross-sectional diagram schematically illustrating a color printer as an example of an image forming apparatus according to a first illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of an image forming apparatus according to an illustrative embodiment of the present invention. According to the present illustrative embodiment, the image forming apparatus employs an intermediate transfer method.

In FIG. 1, the image forming apparatus includes four image forming units 1Y, 1M, 1C, and 1K (which may be collectively referred to as image forming units 1), an optical writing unit 80, a transfer unit 50 including an intermediate transfer belt 51, a fixing device 90, and so forth. Substantially above the intermediate transfer belt 51, the image forming units 1Y, 1M, 1C, and 1K, one for each of the colors yellow, magenta, cyan, and black, are arranged in tandem in the direction of movement of the intermediate transfer belt 51, thereby constituting a tandem image forming station.

It is to be noted that suffixes Y, M, C, and K denote the colors yellow, magenta, cyan, and black, respectively. To simplify the description, the suffixes Y, M, C, and K indicating the colors are omitted herein unless otherwise specified.

Figure 2:
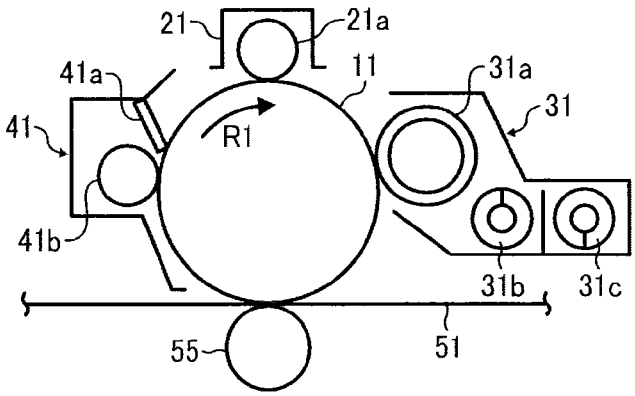
FIG. 2 is a schematic diagram illustrating an image forming unit employed in the image forming apparatus of FIG. 1.

With reference to FIG. 2, a description is provided of the image forming units 1Y, 1M, 1C, and 1K. The image forming units 1Y, 1M, 1C, and 1K all have the same configurations as all the others, differing only in the color of toner employed. Thus, a description is provided of one of the image forming units 1, and the suffix indicating the color is omitted. FIG. 2 is a schematic diagram illustrating the image forming unit 1.

As illustrated in FIG. 2, the image forming unit 1 includes a drum-shaped photosensitive member (hereinafter referred to as simply photosensitive drum) 11, a charging device 21, a developing device 31, a primary transfer roller 55, a cleaning device 41, and so forth. The charging device 21 charges the surface of the photosensitive drum 11 by using a charging roller 21*a*. The developing device 31 develops a latent image formed on the photosensitive drum 11 with a respective color of toner to form a visible image known as a toner image. The primary transfer roller 55 serving as a primary transfer member transfers the toner image from the photosensitive drum 11 to the intermediate transfer belt 51. The cleaning device 41 cleans the surface of the photosensitive drum 11 after primary transfer. According to the illustrative embodiment, the image forming units 1Y, 1M, 1C, and 1K are detachably attachable relative to a main body of the image forming apparatus.

The photosensitive drum 11 is constituted of a drum-shaped base on which an organic photosensitive layer is disposed. The outer diameter of the photosensitive drum 11 is approximately 60 mm. The photosensitive drum 11 is rotated in a clockwise direction indicated by an arrow R1 by a driving device, not illustrated. The charging roller 21*a* of the charging device 21 is supplied with a charging bias. The charging roller 21*a* contacts or is disposed close to the photosensitive drum 11 to generate an electrical discharge therebetween, thereby charging uniformly the surface of the photosensitive drum 11.

According to the present illustrative embodiment, the photosensitive drum 11 is uniformly charged with a negative polarity which is the same polarity as the normal charge on toner. As the charging bias, an alternating current (AC) voltage superimposed on a direct current (DC) voltage is employed. According to the present illustrative embodiment, the photosensitive drum 11 is charged by the charging roller 21*a* contacting or disposed near the photosensitive drum 11. Alternatively, a known charger may be employed.

The developing device 31 includes a developing sleeve 31*a*, and paddles 31*b* and 31*c* inside a developer container. In the developer container, a two-component developing agent consisting of toner particles and carriers is stored. The developing sleeve 31*a* serves as a developer bearing member and faces the photosensitive drum 11 via an opening of the developer container. The paddles 31*b* and 31*c* mix the developing agent and deliver the developing agent to the developing sleeve 31*a*.

According to the present illustrative embodiment, the two-component developing agent is used. Alternatively, a single-component developing agent may be used.

The cleaning device 41 includes a cleaning blade 41*a* and a cleaning brush 41*b* to clean the surface of the photosensitive drum 11. The cleaning blade 41*a* of the cleaning device 41 contacts the surface of the photosensitive drum 11 at a certain angle such that the leading edge of the cleaning blade 41*a* faces counter to the direction of rotation of the photosensitive drum 11. The cleaning brush 41*b* rotates in the direction opposite to the direction of rotation of the photosensitive drum 11 while contacting the photosensitive drum 11.

Referring back to FIG. 1, a description is provided of the optical writing unit 80. The optical writing unit 80 for writing a latent image on each of the photosensitive drums 11Y, 11M, 11C, and 11K (which may be collectively referred to as photosensitive drums 11) is disposed above the image forming units 1Y, 1M, 1C, and 1K. It is to be noted that the suffixes Y, M, C, and K indicating colors are omitted when discrimination therebetween is not required.

Based on image information received from external devices such as a personal computer (PC), the optical writing unit 80 illuminates the photosensitive drums 11Y, 11M, 11C, and 11K with a light beam projected from a laser diode of the optical writing unit 80. Accordingly, the electrostatic latent images of yellow (Y), magenta (M), cyan (C), and black (K) are formed on the photosensitive drums 11Y, 11M, 11C, and 11K, respectively. More specifically, the potential of the portion of the uniformly-charged surface of the photosensitive drums 11 illuminated with the light beam is attenuated. The potential of the illuminated portion of the photosensitive drum 11 with the light beam is less than the potential of the other area, that is, a background portion (non-image formation area), thereby forming an electrostatic latent image on the surface of the photosensitive drum 11.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drum 11. Alternatively, the optical writing unit 80 may employ a light source using an LED array including a plurality of LEDs that projects light.

Still referring to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearing member formed into an endless loop and entrained about a plurality of rollers, thereby rotating endlessly in the counterclockwise direction indicated by a hollow arrow A. The transfer unit 50 also includes a driving roller 52, a secondary-transfer back surface roller 53, a cleaning auxiliary roller 54, four primary transfer rollers 55Y, 55M, 55C, and 55K (which may be referred to collectively as primary transfer rollers 55), a nip forming roller 56, a belt cleaning device 57, a voltage detector 58, and so forth. The primary transfer rollers 55Y, 55M, 55C, and 55K are disposed opposite the photosensitive drums 11Y, 11M, 11C, and 11K, respectively, via the intermediate transfer belt 51.

The intermediate transfer belt 51 is entrained around the driving roller 52, the secondary-transfer back surface roller 53, the cleaning auxiliary roller 54, and the primary transfer rollers 55, all disposed inside the loop formed by the intermediate transfer belt 51. The driving roller 52 is rotated by a driving device (not illustrated), enabling the intermediate transfer belt 51 to move in the direction of arrow A.

The intermediate transfer belt 51 has a thickness in a range of from 20 μm to 200 μm, preferably, approximately 60 μm. The volume resistivity thereof is in a range of from approximately 1e6 [Ωcm] to approximately 1e13 [Ωcm], preferably, in a range of from approximately 1e7.5 [Ωcm] to approximately 1e12.5 [Ωcm], more preferably, approximately 1e9 [Ωcm]. The volume resistivity is measured with an applied voltage of 100V by a high resistivity meter, HIRESTA UPM-CPHT 45 with the HRS probe manufactured by Mitsubishi Chemical Corporation. The volume resistivity is obtained after 10 seconds.

The intermediate transfer belt 51 includes a single layer or multiple layers including, but not limited to, polyimide (PI), polyvinylidene fluoride (PVDF), ethylene tetrafluoroethylene (ETFE), and polycarbonate (PC). The intermediate transfer belt 51 may include a release layer on the surface thereof. The release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The intermediate transfer belt 51 is manufactured through a casting process, a centrifugal casting process, and the like. The surface of the intermediate transfer belt 51 may be ground as necessary.

Alternatively, the intermediate transfer belt 51 may have a three-layer structure including a base layer, an elastic layer, and a coating layer. In such a configuration, the base layer may be made of relatively inelastic fluorocarbon resin or a combination of elastic rubber and a relatively inelastic material such as a canvas.

The elastic layer may be disposed on the base layer and may be made of, for example, fluorine-based rubber and acrylonitrile-butadiene copolymer rubber. The surface of the elastic layer may be covered with the coating layer made of fluorocarbon resin, for example.

The resistivity of the intermediate transfer belt 51 is adjusted by dispersing conductive material such as carbon black therein.

The intermediate transfer belt 51 is interposed between the photosensitive drums 11 (11Y, 11M, 11C, and 11K), and the primary transfer rollers 55 (55Y, 55M, 55C, and 55K). Accordingly, primary transfer nips are formed between the front surface (image bearing surface) of the intermediate transfer belt 51 and the photosensitive drums 11Y, 11M, 11C, and 11K contacting the intermediate transfer belt 51. A primary transfer bias is applied to the primary transfer rollers 55 by a transfer bias power source, thereby generating a transfer electric field between the toner images on the photosensitive drums 11 and the primary transfer rollers 55. Accordingly, the toner images are transferred primarily from the photosensitive drums 11 onto the intermediate transfer belt 51 due to the transfer electric field and a nip pressure at the primary transfer nip. More specifically, the toner images of yellow, magenta, cyan, and black are transferred onto the intermediate transfer belt 51 so that they are superimposed one atop the other, thereby forming a composite toner image on the image bearing surface of the intermediate transfer belt 51.

In the case of monochrome imaging, a support plate supporting the primary transfer rollers 55Y, 55M, and 55C of the transfer unit 50 is moved to separate the primary transfer rollers 55Y, 55M, and 55C from the photosensitive drums 11Y, 11M, and 11C. Accordingly, the front surface of the intermediate transfer belt 51, that is, the image bearing surface, is separated from the photosensitive drums 11Y, 11M, and 11C so that the intermediate transfer belt 51 contacts only the photosensitive drum 11K. In this state, only the image forming unit 1K is activated to form a toner image of black on the photosensitive drum 11K.

Each of the primary transfer rollers 55 is constituted of an elastic roller including a metal cored bar on which a conductive sponge layer is provided. The outer diameter of the primary transfer roller 55 is approximately 16 mm. The diameter of the metal cored bar is approximately 10 mm. The volume resistivity of the primary transfer roller 55 is measured with an applied weight of 5[N] at one side while applying a bias of 1 [kV] to the shaft of the transfer roller using the rotation measurement method in which the volume resistivity is measured while the roller is rotated for one minute (the speed of rotation is approximately 30 rpm, for example). The average is considered as the volume resistivity.

A resistance R of the sponge layer of the primary transfer roller 55 is calculated using Ohm's law R=V/I, where R is a resistance, V is a voltage, and I is a current. Based on the calculation, the resistance R of the sponge layer is in a range of from approximately 1e6Ω to approximately 1e9Ω, preferably approximately 3E7Ω. A primary transfer bias is applied to the primary transfer rollers 55 with constant current control.

According to the illustrative embodiment, a roller-type transfer device (here, the primary transfer rollers 55) is used as a primary transfer device. Alternatively, a transfer charger or a brush-type transfer device may be employed as a primary transfer device.

As illustrated in FIG. 1, the nip forming roller 56 of the transfer unit 50 is disposed outside the loop formed by the intermediate transfer belt 51, opposite the secondary-transfer back surface roller 53 which is disposed inside the loop. The intermediate transfer belt 51 is interposed between the secondary-transfer back surface roller 53 and the nip forming roller 56. Accordingly, a secondary transfer nip is formed between the peripheral surface or the image bearing surface of the intermediate transfer belt 51 and the nip forming roller 56 contacting the image bearing surface of the intermediate transfer belt 51.

According to the present illustrative embodiment, the nip forming roller 56 is grounded, while a secondary transfer bias is applied to the secondary-transfer back surface roller 53 by a secondary transfer bias power source 200. With this configuration, a secondary transfer electric field is formed between the secondary-transfer back surface roller 53 and the nip forming roller 56 so that the toner moves electrostatically from the secondary-transfer back surface roller side to the nip forming roller side.

As illustrated in FIG. 1, a sheet cassette 100 storing a stack of recording media sheets P is disposed below the transfer unit 50. The sheet cassette 100 is equipped with a sheet feed roller 101 to contact a top sheet of the stack of recording media sheets P. As the sheet feed roller 101 is rotated at a predetermined speed, the sheet feed roller 101 picks up the top sheet and feeds it to a sheet passage in the image forming apparatus. Substantially at the end of the sheet passage, a pair of registration rollers 102 is disposed. The pair of registration rollers 102 stops rotating temporarily, immediately after the recording medium P delivered from the sheet cassette 100 is interposed therebetween. The pair of registration rollers 102 starts to rotate again to feed the recording medium P to the secondary transfer nip in appropriate timing such that the recording medium P is aligned with a composite or monochrome toner image formed on the intermediate transfer belt 51 in the secondary transfer nip.

In the secondary transfer nip, the recording medium P tightly contacts the composite or the monochrome toner image on the intermediate transfer belt 51, and the composite or the monochrome toner image is transferred secondarily onto the recording medium P due to the secondary transfer electric field and the nip pressure applied thereto. After the recording medium P, on which the composite or monochrome toner image is transferred, passes through the secondary transfer nip, the recording medium P separates from the nip forming roller 56 and the intermediate transfer belt 51 due to the curvature of the nip forming roller 56 and the intermediate transfer belt 51, also known as self stripping.

The secondary-transfer back surface roller 53 is constituted of a metal cored bar made of, for example, stainless steel and aluminum on which a resistance layer is laminated. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane.

The volume resistivity of the resistance layer is in a range of from approximately $10^6\Omega$ to approximately $10^{12}\Omega$, preferably in a range of from approximately $10^7\Omega$ to approximately $10^9\Omega$. The resistance layer may be a foam-type having the hardness in a range of from approximately 20 degrees to approximately 50 degrees or a rubber-type having a hardness in a range of from approximately 30 degrees to approximately 60 degrees.

Since the secondary-transfer back surface roller 53 contacts the nip forming roller 56 via the intermediate transfer belt 51, the sponge-type layer is preferred because it reliably contacts the nip forming roller 56 via the intermediate transfer belt 51 even with a low contact pressure. With a large contact pressure of the secondary-transfer back surface roller 53 and the intermediate transfer belt 51, image defects such as toner dropouts can be prevented. Toner dropouts are a partial toner transfer failure in character images or thin-line images.

The nip forming roller 56 (a counter roller) is constituted of a metal cored bar made of metal such as stainless steel and aluminum, and a resistance layer and a surface layer made of conductive rubber or the like disposed on the metal cored bar. According to the present illustrative embodiment, the external diameter of the nip forming roller 56 is approximately 20 mm, and the diameter of the metal cored bar is approximately 16 mm. The resistance layer is made of rubber of NBR/ECO copolymer having the hardness in the range of from approximately 40 to approximately 60 degrees according to MS-A.

The surface layer is made of fluorinated urethane elastomer. The thickness thereof is preferably in the range of from 8 μm to 24 μm. This is because the surface layer of the roller is generally formed during coating process, and if the thickness of the surface layer is less than or equal to 8 μm, the effect of uneven resistance due to uneven coating is significant. As a result, leak may occur at a place with low resistance. Furthermore, the surface of the roller may wrinkle, causing cracks in the surface layer.

By contrast, when the thickness of the surface layer is 24 μm or more, the resistance becomes high. In a case in which the volume resistivity is high, the voltage may rise and exceed an allowable range of voltage change of the constant current power source when the constant current is supplied to the metal cored bar of the secondary-transfer back surface roller 53. As a result, the current may drop below the target value.

In a case in which the allowable range of voltage change is sufficiently high, the voltage of a high-voltage path from the constant current power source to the metal cored bar of the secondary-transfer back surface roller and/or the metal cored bar of the secondary-transfer back surface roller may become high, causing the leak easily.

When the thickness of the surface layer of the nip forming roller 56 is 24 μm or more, the hardness becomes high, thereby hindering the nip forming roller 56 from closely contacting the recording medium P and the intermediate transfer belt 51. The surface resistivity of the nip forming roller 56 is equal to or greater than approximately $10^{65}\Omega$, and the volume resistivity of the surface layer is equal to or greater than approximately $10^{10}\Omega$cm, preferably approximately equal to or greater than $10^{12}\Omega$cm.

The nip forming roller 56 may be a foam-type roller without the surface layer. In this case, the volume resistivity of the nip forming roller 56 is in a range of from approximately 6.0 Log$\Omega$ to approximately 8.0 Log$\Omega$, preferably in a range of from approximately 7.0 Log$\Omega$ to 8.0 Log$\Omega$.

The secondary-transfer back surface roller 53 may be a foam-type, a rubber-type, or a metal roller such as SUS. The volume resistivity of the secondary-transfer back surface roller 53 is preferably equal to or less than 6.0 Log$\Omega$, which is lower than that of the nip forming roller 56. Similar to the primary transfer roller 55, the volume resistivity of the nip forming roller 56 and the secondary-transfer back surface roller 53 is measured with an applied weight of 5 [N] at one side while applying a bias of 1 [kV] to the shaft of the transfer roller using the rotation measurement method in which the volume resistivity is measured while the roller is rotated for one minute (the speed of rotation is approximately 30 rpm, for example). The average is considered as the volume resistivity.

The voltage detector 58 is disposed outside the loop formed by the intermediate transfer belt 51, opposite the driving roller 52 which is grounded. More specifically, the voltage detector 58 faces a portion of the intermediate transfer belt 51 entrained around the driving roller 52 with a gap of approximately 4 mm. The surface potential of the toner image primarily transferred onto the intermediate transfer belt 51 is measured when the toner image comes to the position opposite the voltage detector 58.

According to the present embodiment, as the voltage detector 58, a surface potential sensor EFS-22D manufactured by TDK Corp. is used. The voltage detector 58 may serve as the toner image detector. The toner image detector may be an optical detector including one light emitting element and two light receiving elements and convert an output of the received light into an amount of adhered toner, thereby detecting an amount of toner adhered to the toner image primarily transferred onto the intermediate transfer belt 51.

On the right hand side of the secondary transfer nip between the secondary-transfer back surface roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is conveyed to the fixing device 90 and interposed between the fixing roller 91 and the pressing roller 92 in the fixing device 90. Under heat and pressure, the toner adhered to the toner image is softened and fixed to the recording medium P in the fixing nip. Subsequently, the recording medium P is discharged outside the image forming apparatus from the fixing device 90 along the sheet passage after fixing.

According to the illustrative embodiment, the secondary transfer bias power source 200 serving as a secondary transfer bias output device includes a direct current (DC) power source that outputs a DC component, and an alternating current (AC) power source (a superimposed bias power source) that outputs an AC component superimposed on a DC component. In this configuration, the secondary transfer bias power source 200 can output a DC voltage (hereinafter referred to as a DC bias) and an AC voltage superimposed on a DC voltage (hereinafter referred to as a superimposed bias), as the secondary transfer bias.

Figure 3A:
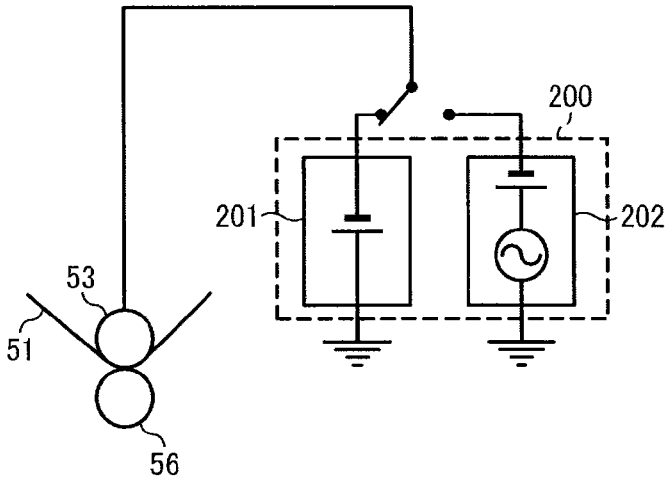
FIG. 3A is a schematic diagram illustrating a secondary transfer portion and a secondary transfer bias power source of the image forming apparatus of FIG. 1 when applying a direct current (DC) bias.
Figure 3B:
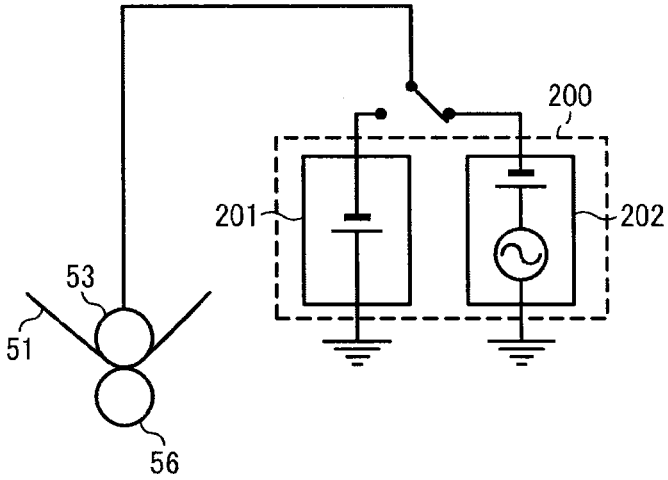
FIG. 3B is a schematic diagrams illustrating the secondary transfer portion and the secondary transfer bias power source of the image forming apparatus when applying a superimposed bias.

With reference to FIGS. 3A and 3B, a description is provided of changing the secondary transfer bias between the DC bias and the superimposed bias. FIG. 3A is a schematic diagram illustrating a secondary transfer portion (here, the secondary-transfer back surface roller 53) and a secondary transfer bias power source 200 when applying a DC bias. FIG. 3B is a schematic diagram illustrating the secondary transfer portion (here, secondary-transfer back surface roller 53) and the secondary transfer bias power source when applying a superimposed bias. As illustrated in FIGS. 3A and 3B, the secondary transfer bias power source 200 includes a DC power source 201 and an AC power source (superimposed bias power source) 202.

Figure 4:
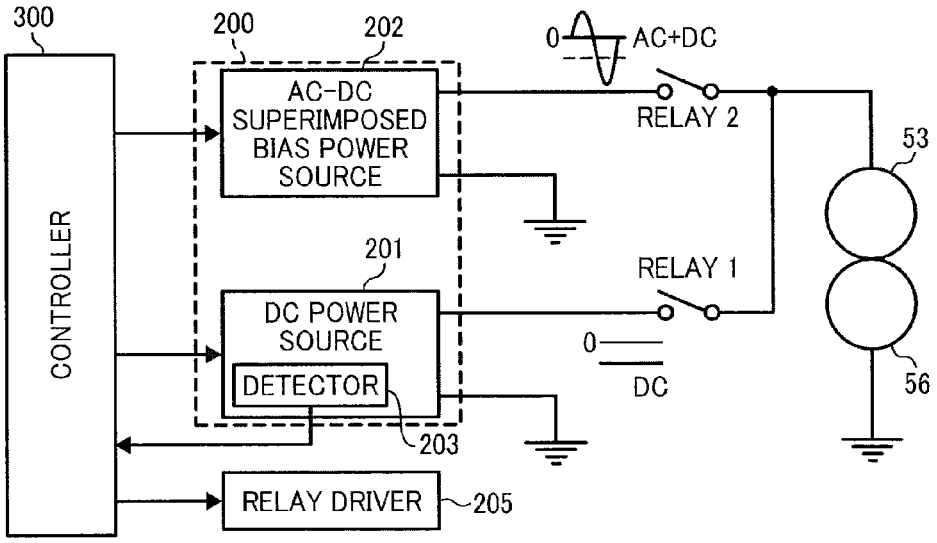
FIG. 4 is a schematic diagram illustrating the secondary transfer bias power source and two relays to switch a transfer bias.

In FIG. 3A, the DC power source 201 applies a DC bias. In FIG. 3B, the AC power source 202 applies a superimposed bias. FIGS. 3A and 3B schematically illustrate switching the power source between the DC power source 201 and the AC power source 202 using a switch. More specifically, as illustrated in FIG. 4, two relays are used for switching the power source between the DC power source 201 and the AC power source 202. Alternatively, as illustrated in FIG. 5, no switching device may be provided.

FIG. 4 is a schematic diagram illustrating a configuration in which two relays are used to switch the secondary transfer bias between the DC bias and the superimposed bias. As illustrated in FIG. 4, the DC power source 201 applies a DC bias to the secondary-transfer back surface roller 53 via a relay 1. The AC power source 202 applies a superimposed bias to the secondary-transfer back surface roller 53 via a relay 2. A controller 300 connects and disconnects the two relays, that is, the relay 1 and the relay 2 via a relay driver 205. Accordingly, the secondary transfer bias is switched between the DC bias and the superimposed bias. The DC power source 201 includes a voltage detector 203 and provides a detected feedback voltage to the controller 300.

Figure 5:
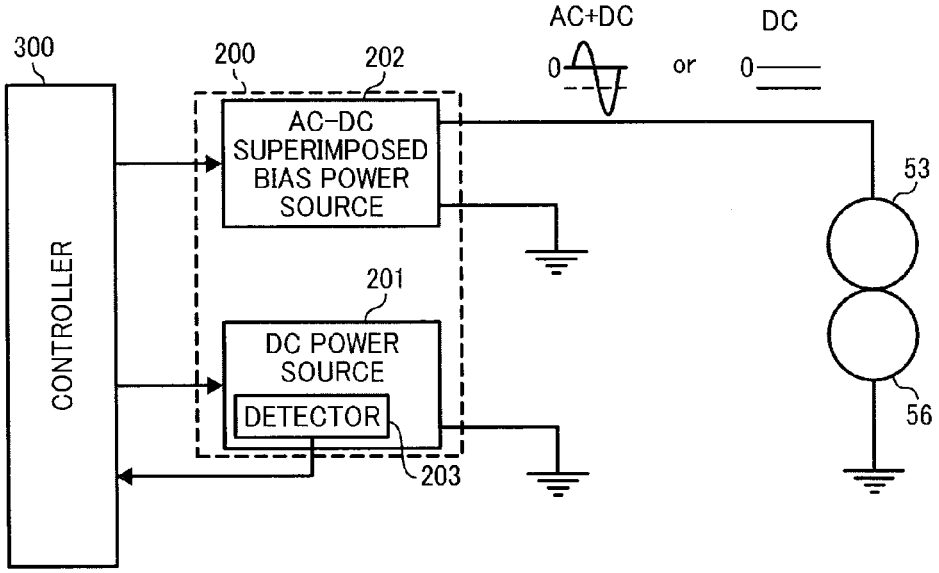
FIG. 5 is a schematic diagram illustrating a configuration for switching the transfer bias without the relays of FIG. 4.

FIG. 5 is a schematic diagram illustrating a configuration in which the secondary transfer bias is switched between the DC bias and the superimposed bias without the relays 1 and 2. As illustrated in FIG. 5, the secondary transfer bias power source 200 includes the DC power source 201 and the AC power source (superimposed power source) 202. The AC power source 202 applies the superimposed bias to the secondary-transfer back surface roller 53. The DC power source 201 applies the DC bias to the secondary-transfer back surface roller 53 via the AC power source 202. The controller 300 switches the secondary transfer bias between the DC bias and the superimposed bias. The DC power source 201 includes the voltage detector 203 and provides the detected feedback voltage to the controller 300.

It is to be noted that the configurations for supplying the voltage and the power source for transfer are not limited to the configurations described above. The configurations may be varied in many ways. The variations are described later.

Figure 6:
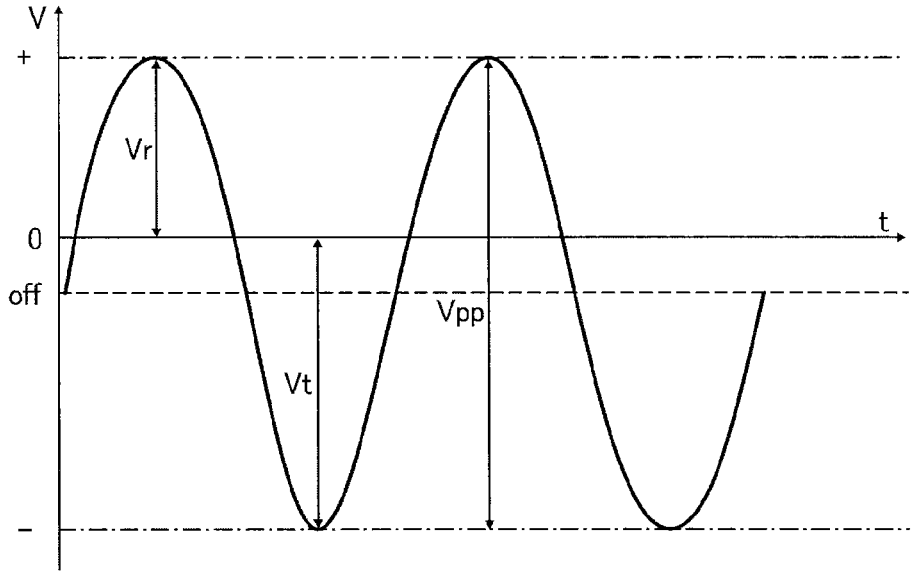
FIG. 6 is a waveform chart showing an example of a waveform of the superimposed bias serving as the transfer bias.

With reference to FIG. 6, a description is provided of an effect of the superimposed bias. FIG. 6 is a waveform chart showing an example of a waveform of the superimposed bias.

In FIG. 6, an offset voltage Voff is a value of a direct current (DC) component of the superimposed bias. A peak-to-peak voltage Vpp is an alternating current (AC) component of a peak-to-peak voltage of the superimposed bias. According to the illustrative embodiment, the superimposed bias consists of a superimposed voltage in which the offset voltage Voff and the peak-to-peak voltage Vpp are superimposed. Thus, a time-averaged value of the superimposed bias coincides with the offset voltage Voff.

In the present illustrative embodiment, the superimposed bias has a sinusoidal waveform which includes a peak at a positive side and a peak at a negative side. In FIG. 6, a reference sign Vt refers to one of the two peak values, that is, the peak value for moving the toner in the secondary transfer nip N from the belt side to the recording medium side, i.e. the negative peak value in the present example (hereinafter referred to as a transfer peak value Vt). A reference sign Vr refers to the other peak value, that is, the peak value for returning the toner from the recording medium side to the belt side, i.e. the positive peak value in the present example (hereinafter referred to as a returning peak value Vr).

If the superimposed bias including the DC component is applied to adjust the offset voltage Voff, that is, the time-averaged value of the superimposed bias, to the same polarity as the toner (here, negative polarity), the toner is enabled to move relatively from the belt side toward the recording medium P while the toner moves back and forth between the belt side and the recording medium side. Accordingly, the toner can be transferred relatively onto the recording medium P.

According to the present illustrative embodiment, an AC voltage having a sine wave is used. Alternatively, an AC voltage having a rectangular wave may be used.

The time for transferring the toner having the AC component from the belt side to the recording medium side can be different from the time for returning the toner from the recording medium to the belt side.

Next, a description is provided of variations of an AC component of the superimposed bias.

Example 1

In a first example (EXAMPLE 1), for the AC component, an inclination of rising and falling of the voltage at a return direction side (toner returning from the recording medium to the belt side) is less than that of at a transfer direction side (toner transferring from the belt side to the recording medium). More specifically, a time A at the transfer direction side during which the voltage closer to the transfer direction side than from the center voltage value Voff is output, is longer than a return time B during which the voltage having a value closer to the polarity opposite to the transfer direction than from the center voltage value Voff is output. (A>B)

Figure 7:
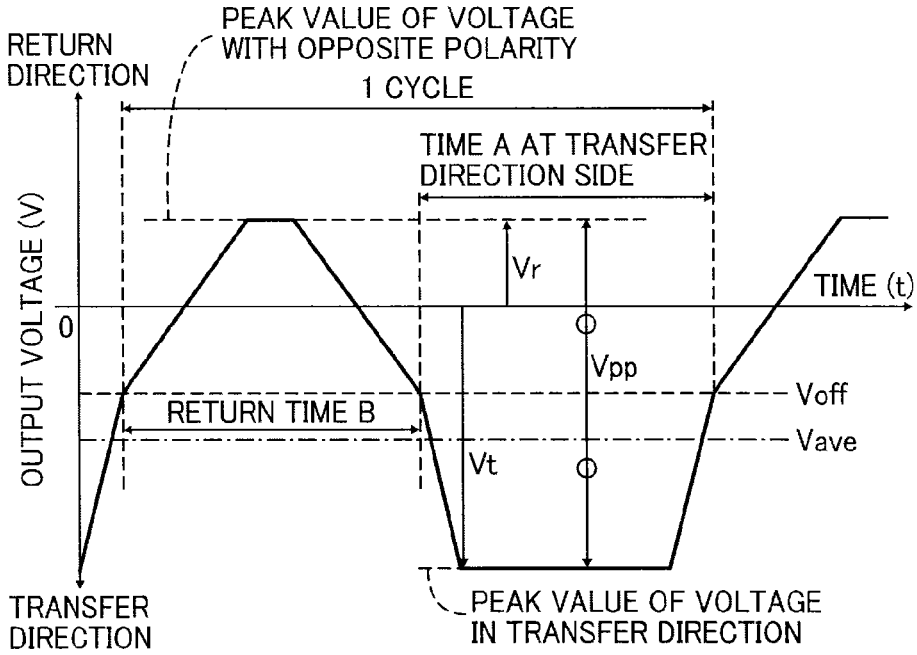
FIG. 7 is a waveform chart showing a first example of an AC component of the superimposed bias.

FIG. 7 shows a waveform chart of the EXAMPLE 1. According to the present illustrative embodiment, the return time is 40%, and the effect thereof is shown in FIG. 8.

In FIG. 8, when the peak-to-peak voltage Vpp is 12 kV and the time-averaged value Vave of the voltage is −5.4 kV, the center voltage value Voff is −4.0 kV.

Example 2

In a second example (EXAMPLE 2), for the AC component, an inclination of rising and falling of the voltage at the return direction side is less than that of at the transfer direction side. More specifically, a transition time t1, during which the voltage shifts from the peak value of the voltage in the transfer direction to the center voltage value Voff, is shorter than a transition time t2, during which the voltage shifts from the center voltage value Voff to the peak value of the voltage having the polarity opposite that of the voltage in the transfer direction. (t2>t1)

Figure 9:
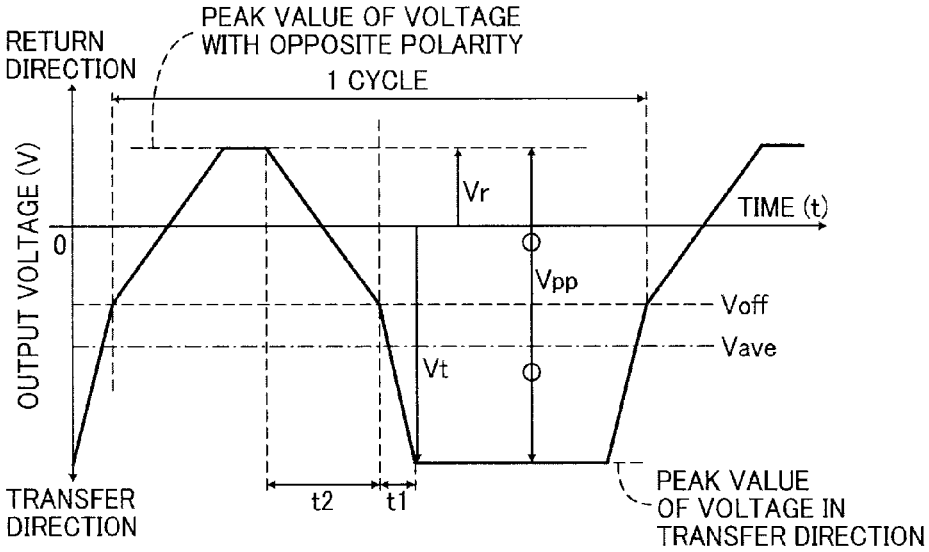
FIG. 9 is a waveform chart showing a second example of the AC component of the superimposed bias.
Figure 10:
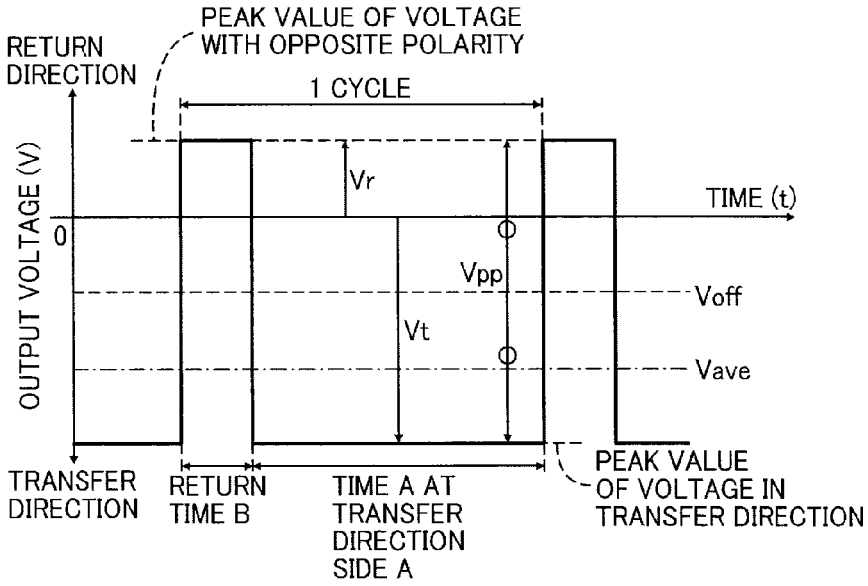
FIG. 10 is a waveform chart showing a third example of the AC component of the superimposed bias.

FIG. 9 shows a waveform chart of the second example. According to the present illustrative embodiment, the return time is 40%, and the effect thereof is shown in FIG. 8. With this configuration, the time-averaged value Vave of the voltage can be closer to the transfer direction side than from the center voltage value Voff of the minimum and the maximum of the voltage.

Example 3

In order to make an area at the return direction side smaller than an area at the transfer direction side relative to the center voltage value Voff of the AC component, in a third example (EXAMPLE 3), the return time B is shorter than the time A at the transfer side. With this configuration, the return time B is shorter than the time A at the transfer direction side.

Example 4

Figure 11:
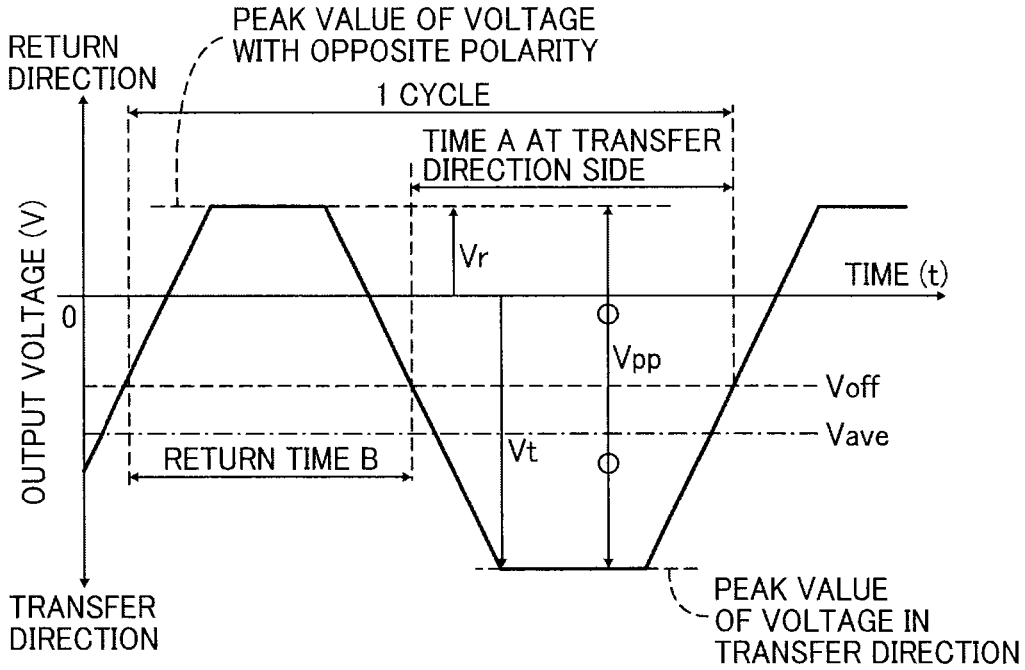
FIG. 11 is a waveform chart showing a fourth example of the AC component of the superimposed bias.

In a fourth example (EXAMPLE 4), for the AC component, the return time B is shorter than the time A at the transfer direction side. FIG. 11 shows a waveform chart of the fourth example. According to the present illustrative embodiment, the return time is 45%, and the effect thereof is shown in FIG. 12.

Example 5

Figure 13:
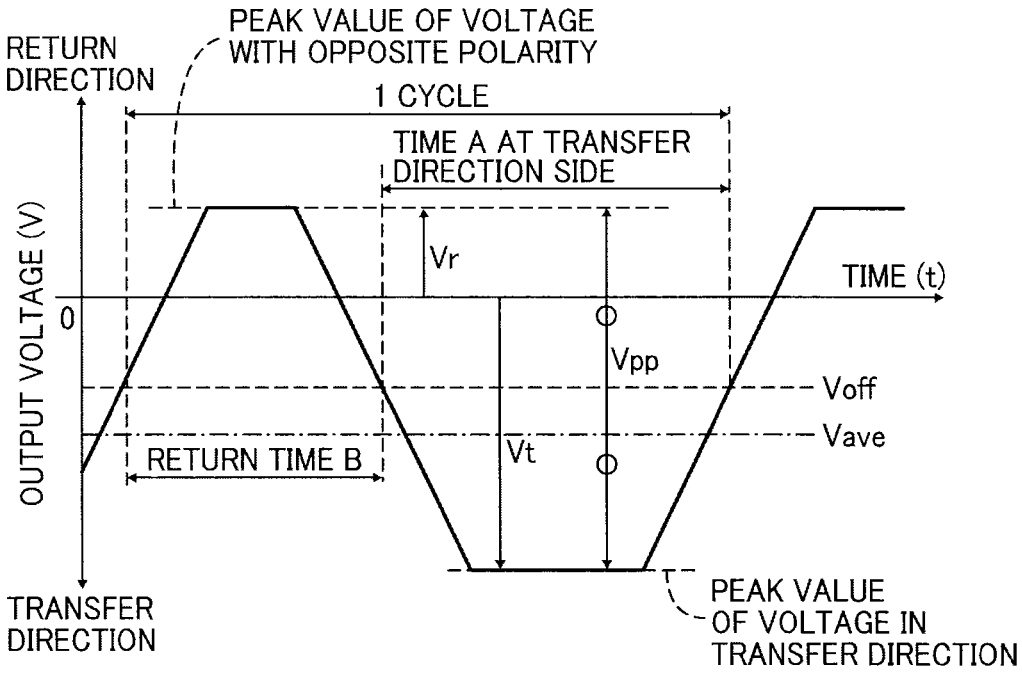
FIG. 13 is a waveform chart showing a fifth example of the AC component of the superimposed bias.

In a fifth example (EXAMPLE 5), for the AC component, the return time B is shorter than the time A at the transfer direction side. FIG. 13 shows a waveform chart of the fifth example. According to the present illustrative embodiment, the return time is 40%, and the effect thereof is shown in FIG. 14.

Example 6

Figure 15:
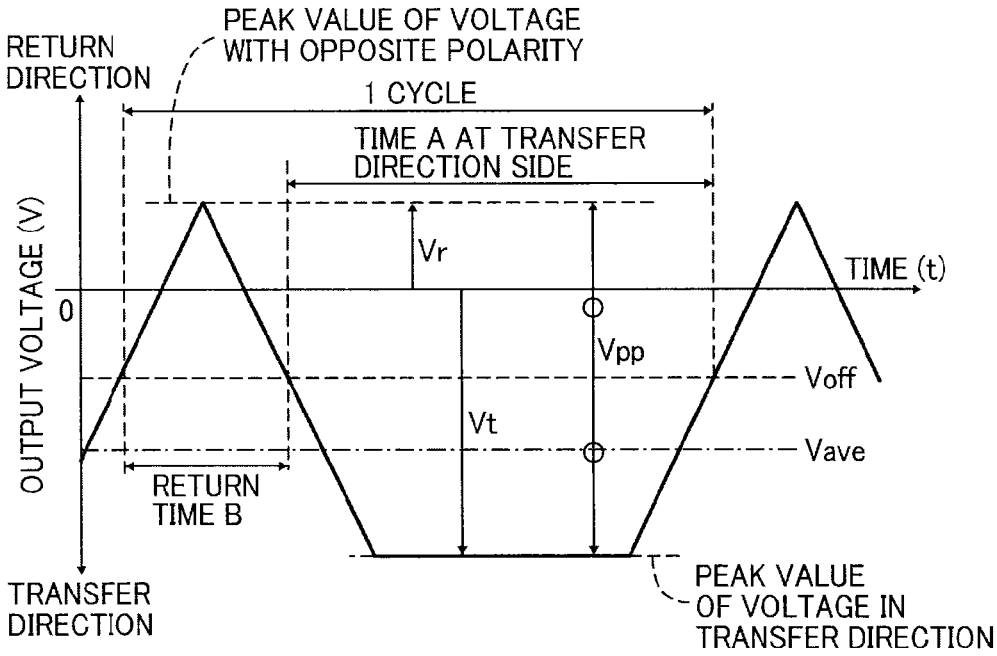
FIG. 15 is a waveform chart showing a sixth example of the AC component of the superimposed bias.

In a sixth example (EXAMPLE 6), as the AC component, the return time B is shorter than the time A at the transfer direction side. FIG. 15 shows a waveform chart of the sixth example. According to the present illustrative embodiment, the return time is 32%, and the effect thereof is shown in FIG. 16.

Example 7

Figure 17:
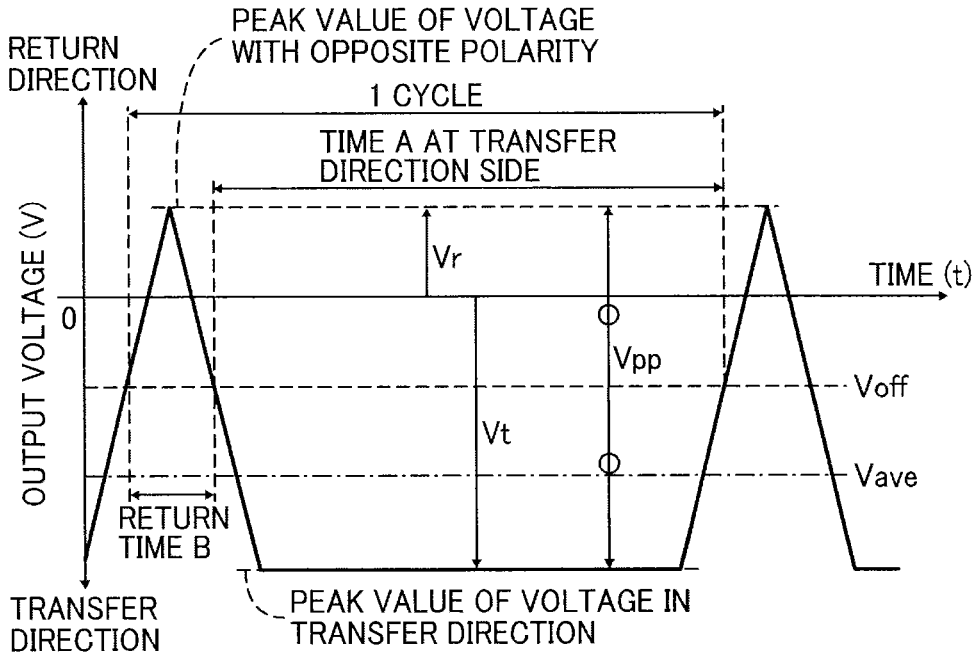
FIG. 17 is a waveform chart showing a seventh example of the AC component of the superimposed bias.

In a seventh example (EXAMPLE 7), for the AC component, the return time B is shorter than the time A at the transfer direction side. FIG. 17 shows a waveform chart of the seventh example. According to the present illustrative embodiment, the return time is 16%, and the effect thereof is shown in FIG. 18.

Example 8

Figure 19:
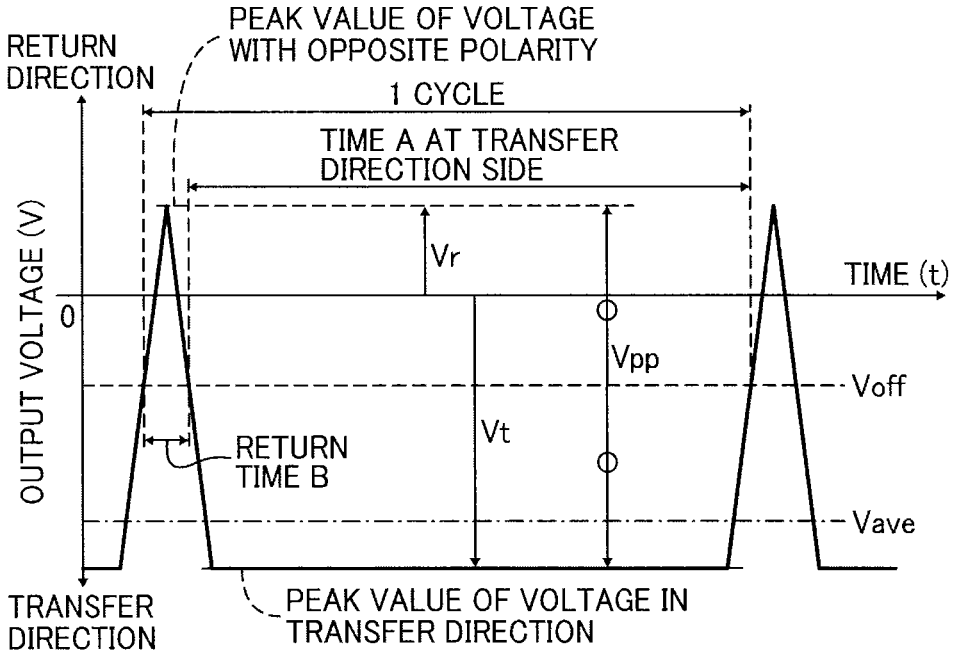
FIG. 19 is a waveform chart showing an eighth and ninth examples of the AC component of the superimposed bias.

In an eighth example (EXAMPLE 8), for the AC component, the return time B is shorter than the time A at the transfer direction side. FIG. 19 shows a waveform chart of the eighth example. According to the present illustrative embodiment, the return time is 8%, and the effect thereof is shown in FIG. 20.

Example 9

In a ninth example (EXAMPLE 9), for the AC component, the return time B is shorter than the time A at the transfer direction side. The waveform of this example is the same as FIG. 19. According to the present illustrative embodiment, the return time is 4%, and the effect thereof is shown in FIG. 21.

Example 10

Figure 22:
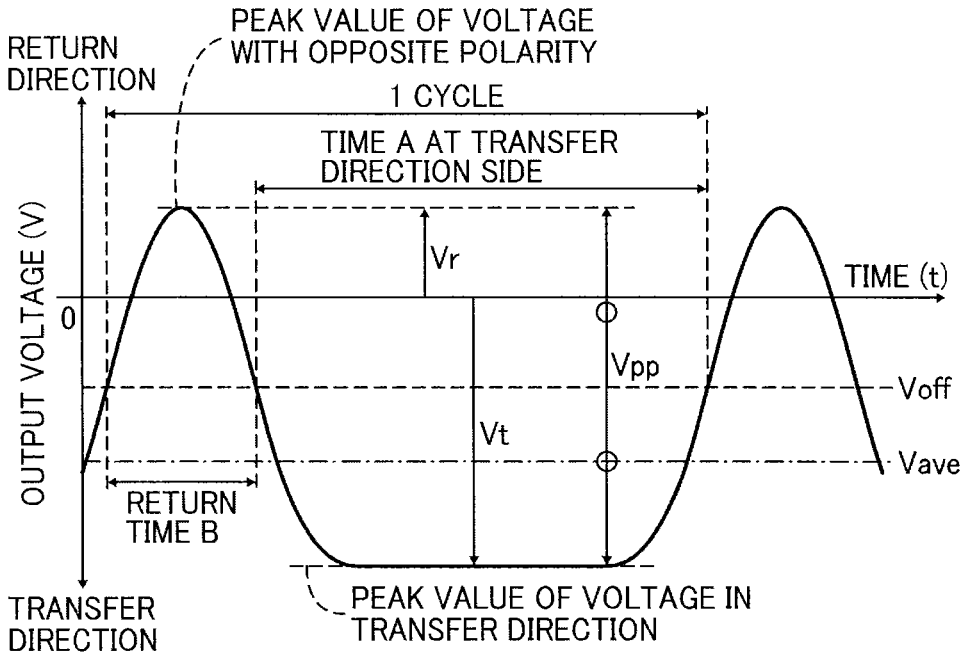
FIG. 22 is a waveform chart showing a tenth example of the AC component of the superimposed bias.

In a tenth example (EXAMPLE 10), for the AC component, the return time B is shorter than the time A at the transfer direction side, and the waveform is rounded. FIG. 22 shows a waveform chart of the tenth example. According to the present illustrative embodiment, the return time is 16%, and the effect thereof is shown in FIG. 23. In FIG. 23, when the peak-to-peak voltage Vpp is 12 kV and the time-averaged value Vave of the voltage is −5.4 kV, the center voltage value Voff is −2.4 kV.

When using a recording medium having a coarse surface such as an embossed sheet and a Japanese sheet having a high degree of surface roughness, it is known that application of the superimposed bias can move the toner from the belt side to the recording medium relatively while moving the toner back and forth. With this configuration, the transferability of the toner relative to the recessed portions on the recording medium is enhanced, thus preventing image defects such as dropouts and blank spots.

By contrast, when using a normal sheet having a relatively smooth surface, application of a secondary transfer bias including only a DC component can achieve sufficient transferability of toner. It is to be noted that a sheet having a coarse surface herein refers, for example, to embossed paper or also known as textured paper including, but not limited to, Leathac (registered trademark) and linen paper, having a maximum embossed groove depth equal to or greater than approximately 60 μm.

According to the present illustrative embodiment, as described above, the image forming apparatus includes a direct-current (DC) transfer mode and a superimposed transfer mode. In the DC transfer mode, a DC bias is applied as a secondary transfer bias to transfer secondarily an image onto a recording medium. In the superimposed transfer mode, a superimposed bias including an alternating current superimposed on a direct current is applied to transfer secondarily an image onto a recording medium. The DC transfer mode and the superimposed transfer mode are switchable.

Depending on the type of the recording medium, the transfer mode can be switched between the DC transfer mode and the superimposed transfer mode, thereby transferring sufficiently the toner onto a recording medium regardless of the surface conditions of the recording medium. The transfer mode may be switched automatically in accordance with the types of recording media. Alternatively, a user may choose the transfer mode. In either case, the transfer mode may be set using a control panel of the image forming apparatus.

According to the present illustrative embodiment shown in FIG. 1, the superimposed bias including the AC component superimposed on the DC component is applied to the secondary-transfer back surface roller 53. Alternatively, one of the DC bias and the AC bias is applied to the secondary-transfer back surface roller 53, and the other bias is applied to the nip forming roller 56. Still alternatively, the superimposed bias including the AC component superimposed on the DC component is applied to the nip forming roller 56.

In such cases, the polarity of the toner and the polarity of the bias to be applied need to correspond to each configuration. It is to be noted that when using a normal sheet of paper, such as the one having a relatively smooth surface, the transfer bias consisting only of the DC component (DC bias) may be applied as a transfer bias. By contrast, when using a recording medium having a coarse surface such as pulp paper and embossed paper, the transfer bias needs to be changed from the transfer bias consisting only of the DC component to the superimposed bias.

Next, a description is provided of the secondary transfer bias. In a first illustrative embodiment (EMBODIMENT 1), the DC component is under constant current control, and the AC component is under constant voltage (peak-to-peak) control.

Figure 24:
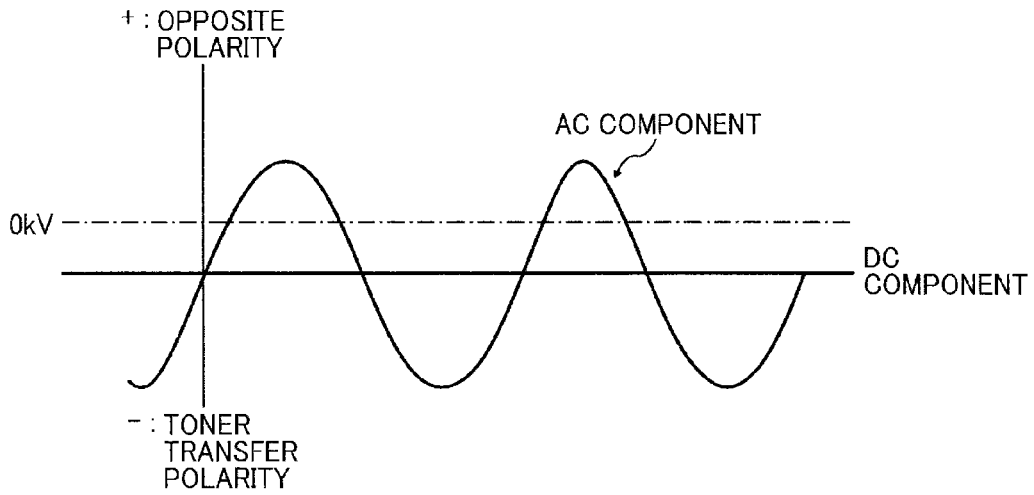
FIG. 24 is a waveform chart showing a waveform of the superimposed bias according to an illustrative embodiment of the present invention.

FIG. 24 is a waveform chart showing an example of a waveform of the superimposed bias serving as a secondary transfer bias. According to the present illustrative embodiment, the image forming apparatus employs a repulsive-force transfer (repulsive transfer) method in which the secondary transfer bias is applied to the secondary-transfer back surface roller 53. In this configuration, because the charging polarity of toner (polarity of normal charge on the toner) is negative (−), the polarity of the transfer bias at the toner transfer side is negative, and the waveform of the superimposed bias switches between the polarity of the toner transfer side and the polarity opposite that of the toner transfer side.

An output value of the DC component and the AC component of the superimposed bias is obtained by multiplying a standard value for the DC component and the AC component by correction values in accordance with a device environment (environment correction), in accordance with a printing speed (linear velocity correction), and in accordance with a sheet width in a main-scanning direction, a thickness of the sheet, and a combined resistance at the secondary transfer portion (sheet size correction).

An example of calculation of the corrections is described below. However, the method of calculation is not limited to the following, and any other suitable calculation methods may be employed.

For the environment correction, the environment is categorized into groups in advance based on a temperature and/or humidity. In accordance with a relative temperature and/or humidity detected by a temperature/humidity detector, an environment group is determined, and a correction value (correction ratio) for the environment group is determined TABLE 1 shows an example of the environment groups based on a relative temperature and humidity.

Alternatively, an environment group based on an absolute humidity is set in advance, and the absolute humidity is obtained from the relative temperature and humidity detected by the temperature/humidity detector. Based on the obtained absolute humidity, an environment group is determined, and a correction value is determined. TABLE 2 shows an example of the environment groups based on an absolute humidity.

In TABLES 1 and 2, MM refers to a standard environment (normal-temperature, normal-humidity environment), HH refers to a high temperature environment (a high-temperature, high-humidity environment), and LL refers to a low temperature environment (a low-temperature, low-humidity environment).

TABLE 2

| ENVIRONMENT GROUP | ABSOLUTE HUMIDITY D (g/m^3) |
|---|---|
| LL | D < 5.0 |
| MM | 5.0 ≤ D < 15.0 |
| HH | 15.0 ≤ D |

The linear velocity correction is obtained in accordance with the printing speed of the image forming apparatus. According to the present illustrative embodiment, the linear velocity includes three speeds: a standard speed, a medium speed (70% of the standard speed), and a slow speed (50% of the standard speed).

The sheet size correction includes three criteria including the sheet width in the main scanning direction, the thickness of the sheet, and the combined resistance at the secondary transfer portion. As shown in TABLES 3 through 5, each of the evaluation criteria is further categorized into three levels. According to the present illustrative embodiment, the width of the recording medium in the main scanning direction and the thickness thereof are obtained from a sheet cassette setting.

The combined resistance of the secondary transfer portion is obtained by calculating an output voltage when a certain current (in the present illustrative embodiment, approximately −50 μA) is supplied during manufacture, adjustment by a technician, or an automatic adjustment at printing operation. Based on the result, a resistance group is determined. In TABLE 5, "R-L" refers to a relatively low combined resistance. "R-M" refers to a standard combined resistance. "R-H" refers to a relatively high combined resistance.

TABLE 3

| | BASIS WEIGHT |
|---|---|
| THICKNESS 1 | 60 gsm~120 gsm |
| THICKNESS 2 | 120.1 gsm~200 gsm |
| THICKNESS 3 | 200.1 gsm~300 gsm |

TABLE 4

| | WIDTH IN MAIN SCANNING: W(mm) DIRECTION |
|---|---|
| SIZE 1 | 250 < W |
| SIZE 2 | 180 < W ≤ 250 |
| SIZE 3 | W ≤ 180 |

TABLE 1

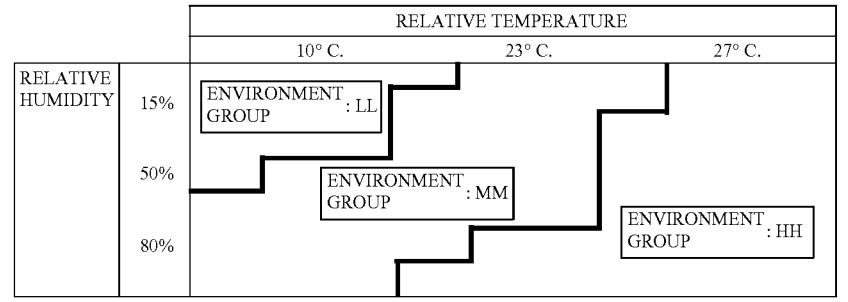

TABLE 5

| | DETECTED VOLTAGE: V (kV) |
|---|---|
| R-L | V ≤ 1.0 |
| R-M | 1.0 < V ≤ 3.0 |
| R-H | 3.0 < V |

The correction values are described below. However, these values described below are only examples, and are not limited to the following. It is to be noted that the following correction values, that is, correction ratios, are expressed in percentage (%) to a standard value. The specific standard value (values for the voltage, the current, and so forth) is set in accordance with the configuration of the device.

TABLE 6 shows environment correction values for each environment group described above according to the present illustrative embodiment. Toner employed in the present illustrative embodiment is negatively charged, and an absolute value of electrical charge increases as the temperature decreases (for example, from −25 μC/g to −40 μC/g). Thus, in the low temperature environment (LL environment), both the DC component and the AC component need to be corrected (in the positive direction) such that the DC component and the AC component become greater than the standard value to obtain a bias necessary for transfer as compared with the normal temperature environment (MM environment).

By contrast, the higher the temperature, the lower the absolute value of electrical charge on toner. Thus, in the high temperature environment (HH environment) relative to the normal temperature environment (MM environment), both the DC component and the AC component need to be corrected (in the negative direction) such that the DC component and the AC component become less than the standard value.

TABLE 6

| | ENVIRONMENT GROUP | | |
|---|---|---|---|
| | LL | MM | HH |
| DC COMPONENT | 110% | 100% | 90% |
| AC COMPONENT | 120% | 100% | 80% |

With reference to FIG. 6, a description is provided of the environment correction.

In the low temperature environment, an amount of correction required for the AC component is greater than that of the DC component. That is, a correction ratio (%) for the AC component is greater than that of the DC component. More specifically, according to the present illustrative embodiment, the correction ratio of the AC component is approximately 120%. The correction ratio of the DC component is approximately 110%. This is because the transferability of toner relative to the recessed portions of the recording medium depends on the AC component, and the transferability of toner relative to the projecting portions of the recording medium depends on the DC component. In other words, the AC component contributes to the transferability of toner at a different portion from the DC component. This means that if the same correction is made to the AC component and the DC component, for example, the same correction value or the same correction ratio (%) as that of the DC component is applied to the AC component, the toner is not transferred well to the recessed portions of the recording medium due to insufficient correction of the AC component, causing white spots in the image.

Similar to the low temperature environment, the amount of correction required for the AC component in the high temperature environment is greater than that of the DC component. That is, the correction ratio (%) of the AC component is greater than that of the DC component. More specifically, according to the present illustrative embodiment, the correction ratio of the AC component is approximately 80%. The correction ratio of the DC component is approximately 90%.

If the same correction is made to the AC component and the DC component, for example, the same correction value or ratio (%) as that of the DC component is applied to the AC component, the AC component is corrected improperly (excessively), thus causing electric discharge. As a result, white spots are generated in the resulting image. In both the low and the high environment, a relatively large amount of correction (correction ratio (%)) is required for the AC component because for the AC component, correction is made to the peak-to-peak of the AC component. In other words, the AC component needs to be corrected at both the positive and the negative polarities.

By contrast, for the DC component, because the DC component is under constant current control, in order to supply the same level of the transfer voltage as that of the normal environment (MM environment), a large amount of correction is not required for the electric current, and the correction is made to the polarity at only one side (in the present illustrative embodiment, the negative polarity).

Figure 25:
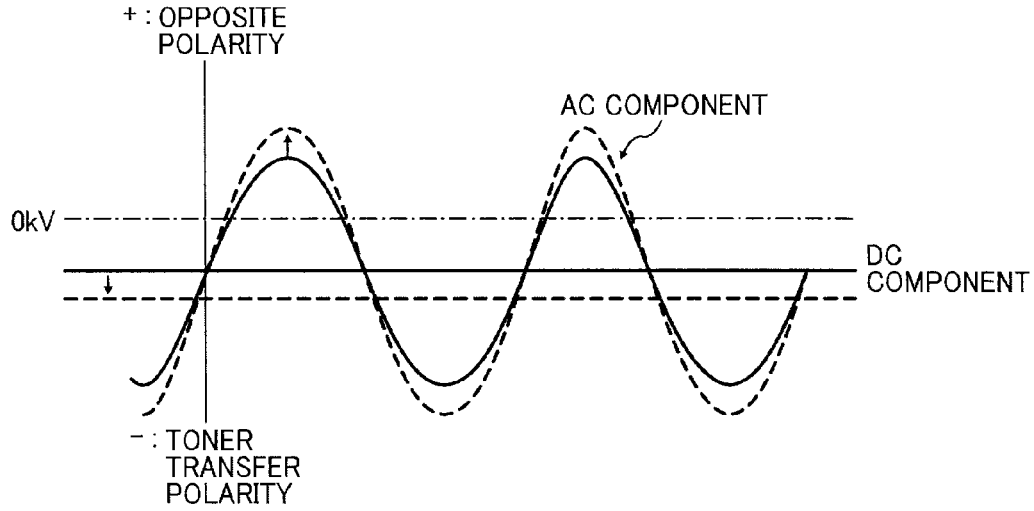
FIG. 25 is a waveform chart showing waveforms of the AC component and the DC component under a normal environment and a low-temperature environment.

FIG. 25 is a waveform chart showing waveforms of the AC component and the DC component under the normal environment (MM environment) and a low temperature (LL) environment. In FIG. 25, a solid line represents a waveform under the normal environment. A broken line represents a waveform under the low temperature environment.

As described above, the correction ratio of the AC component is different from that of the DC component. With this configuration, depending on the environment, the toner can be transferred well to the recessed portions and the projecting portions of the recording medium. In other words, good transferability of the toner is achieved at both the recessed portions as well as the projecting portions.

With reference to TABLE 7, a description is provided of the linear velocity correction according to the present illustrative embodiment. TABLE 7 shows the linear velocity correction in accordance with the printing speed.

As described above, the DC component is under the constant current control. Thus, when the printing speed is slower than the standard printing speed, the DC component is corrected to be less than a standard bias. By contrast, because the AC component is under constant voltage control, it is not necessary to correct in accordance with the printing speed.

Thus, the AC component has the same setting as at the standard speed.

TABLE 7

| | STANDARD SPEED | MEDIUM SPEED | SLOW SPEED |
|---|---|---|---|
| DC COMPONENT | 100% | 70% | 50% |
| AC COMPONENT | 100% | 100% | 100% |

A more detailed description is provided with reference to TABLE 7.

For both the DC component and the AC component the correction is set 100% so as to make the standard speed as a reference speed (the bias to be applied at the standard speed is set to have the same value as the reference bias). As for the DC component, as the printing speed gets slower, for example, from a medium speed to a slow speed, the DC component is corrected to be less than the standard bias, i.e. 70% and 50% of the standard bias, respectively, so that the electric charge per unit time is constant when the recording medium passes through the secondary transfer nip.

By contrast, the correction ratio of the AC component is 100% at any printing speed, which is the same correction ratio at the standard speed. Because the AC component is under constant voltage control, the voltage required in the secondary transfer nip is supplied constantly even when the printing speed varies.

In a case in which the printing speed is relatively slow, if the same correction ratio as that of the DC component is applied to the AC component, for example, the correction ratio of the AC component is the same as that of the DC component, the toner is not transferred well to the recessed portions of the recording medium due to insufficient correction of the AC component, causing white spots in the image.

In view of the above, according to the present illustrative embodiment, a correction ratio of the AC component is different from that of the DC component. With this configuration, the toner can be transferred well to the recessed portions and the projecting portions of the recording medium in accordance with the printing speed. In other words, good transferability of the toner is achieved at both the recessed portions as well as the projecting portions in accordance with the printing speed.

Next, with reference to TABLES 8 through 10, a description is provided of the sheet size correction according to an illustrative embodiment of the present illustrative embodiment.

TABLE 8

| RESISTANCE GROUP: R-L | | | | | | |
|---|---|---|---|---|---|---|
| | THICKNESS 1 | | THICKNESS 2 | | THICKNESS 3 | |
| SHEET SIZE | DC COMPONENT | AC COMPONENT | DC COMPONENT | AC COMPONENT | DC COMPONENT | AC COMPONENT |
| SIZE 1 | 100% | 90% | 100% | 90% | 100% | 90% |
| SIZE 2 | 140% | 90% | 170% | 90% | 200% | 90% |
| SIZE 3 | 190% | 90% | 220% | 90% | 250% | 90% |

TABLE 9

| RESISTANCE GROUP: R-M | | | | | | |
|---|---|---|---|---|---|---|
| | THICKNESS 1 | | THICKNESS 2 | | THICKNESS 3 | |
| SHEET SIZE | DC COMPONENT | AC COMPONENT | DC COMPONENT | AC COMPONENT | DC COMPONENT | AC COMPONENT |
| SIZE 1 | 100% | 100% | 100% | 100% | 100% | 100% |
| SIZE 2 | 120% | 100% | 130% | 100% | 140% | 100% |
| SIZE 3 | 140% | 100% | 160% | 100% | 180% | 100% |

TABLE 10

| RESISTANCE GROUP: R-H | | | | | | |
|---|---|---|---|---|---|---|
| | THICKNESS 1 | | THICKNESS 2 | | THICKNESS 3 | |
| SHEET SIZE | DC COMPONENT | AC COMPONENT | DC COMPONENT | AC COMPONENT | DC COMPONENT | AC COMPONENT |
| SIZE 1 | 100% | 110% | 100% | 110% | 100% | 110% |
| SIZE 2 | 105% | 110% | 110% | 110% | 115% | 110% |
| SIZE 3 | 110% | 110% | 120% | 110% | 130% | 110% |

In a case in which the width of the recording medium in the main scanning direction is relatively narrow, the recording medium is relatively thick, and the combined resistance is relatively low, a relatively large correction is made to the DC component. That is, a relatively large correction ratio (%) is applied to the DC component. Because the DC component is under constant current control, a relatively large amount of current leaks outside the recording medium in any of the conditions above. In order to secure a sufficient current to transfer the toner to the recording medium, the correction ratio is substantially large in accordance with the conditions.

The difference in each correction is described in detail with reference to TABLES 8 through 10. (As for the sheet size, refer to TABLE 4.)

First, a description is provided of correction in accordance with the width of the recording medium in the main scanning direction when using a recording medium of a resistance group R-M, a thickness 1 shown in TABLE 11.

TABLE 11

| RESISTANCE GROUP: R-M THICKNESS 1 | | |
|---|---|---|
| SIZE | DC COMPONENT | AC COMPONENT |
| SIZE 1 | 100% | 100% |
| SIZE 2 | 120% | 100% |
| SIZE 3 | 140% | 100% |

As shown in TABLE 11, the correction ratio of the DC component is 100% (no change from the reference value) when using a recording medium of Size 1 having a width W wider than 250 mm (250 mm<W). By contrast, the correction ratio of the DC component is 140% when using a recording medium of Size 3 having the width W equal to or less than 180 mm. The smaller the size of the recording medium, the more current leaks outside the recording medium. In order to secure a sufficient current to transfer the toner to the recording medium, the correction ratio is substantially large.

Because the AC component is under constant voltage control, the current that leaks outside the recording medium does not affect the AC component. Thus, the same correction ratio (100%) is applied to the AC component regardless of the size of the recording medium.

If the same correction as that of the DC component is applied to the AC component, for example, the same correction ratio (%) as that of the DC component is applied to the AC component, the AC component is corrected excessively, thereby causing electrical discharge and hence resulting in white spots in the image.

Next, a description is provided of correction in accordance with the thickness of the recording medium when using a recording medium of a resistance group R-M, the sheet size 3 shown in TABLE 12. (As for the thickness of the sheet, refer to TABLE 3.)

TABLE 12

| RESISTANCE GROUP: R-M SHEET SIZE 3 | | |
|---|---|---|
| THICKNESS | DC COMPONENT | AC COMPONENT |
| THICKNESS 1 | 140% | 100% |
| THICKNESS 2 | 160% | 100% |
| THICKNESS 3 | 180% | 100% |

The correction ratio of the DC component is 140% for a recording medium having a thickness 1 having the basis weight in a range of from approximately 60 gsm to approximately 120 gsm. The correction ratio of the DC component is 180% for a recording medium having a thickness 3 having the basis weight in a range of from 200.1 gsm to approximately 300 gsm. The thicker the recording medium, the higher the sheet resistance. This means that the current required for transfer is difficult to flow. Because the DC component is under constant current control, if the size of the recording medium is relatively large, the current does not leak outside the recording medium. In this case, no correction is necessary. (In TABLE 9, the correction ratio is 100% for the recording medium having the thicknesses 1 through 3 of the resistance group R-M, Size 1.)

However, in a case in which the recording medium is small, the resistance outside the recording medium is relatively low compared with the area of the recording medium, thereby increasing the current that leaks outside the recording medium.

In view of the above, in order to secure a sufficient current to transfer the toner to the recording medium, the correction ratio is substantially large.

Because the AC component is under constant voltage control, the current that leaks outside the recording medium does not affect. Thus, the same correction ratio (100%) is applied for the AC component regardless of the thickness of the recording medium.

If the same correction ratio as that of the DC component is applied to the AC component in accordance with the thickness of the recording medium, for example, the same correction ratio (%) as that of the DC component is applied to the AC component, the AC component is corrected excessively, thereby causing electrical discharge and hence generating white spots in the image.

Next, a description is provided of correction in accordance with the resistance group of the recording medium when using the recording medium having the thickness 1, the sheet size 3 shown in TABLE 13.

TABLE 13

| THICKNESS 1 SHEET SIZE 3 | | |
|---|---|---|
| RESISTANCE GROUP | DC COMPONENT | AC COMPONENT |
| R-L | 190% | 90% |
| R-M | 140% | 100% |
| R-H | 110% | 110% |

The correction ratio of the DC component in a resistance group R-L with a low combined resistance is 190%. By contrast, the correction ratio of the DC component in a resistance group R-H with a high combined resistance is 110%. The lower the combined resistance, the more current leaks outside the recording medium. In order to secure a sufficient current to transfer the toner to the recording medium, a substantially large correction ratio is applied.

In a case in which the combined resistance is low, the AC component is corrected such that the bias to be applied is low (lower than the reference value). By contrast, in a case in which the combined resistance is high, the AC component is corrected such that the bias to be applied is high (higher than the reference value). In order to maintain the same voltage in the secondary transfer nip when transferring the toner to the recording medium regardless of the combined resistance, a high voltage is necessary when the combined resistance (in particular, the resistance of the secondary-transfer back surface roller) is high, considering voltage drop.

Thus, according to the present illustrative embodiment, as shown in TABLE 13, the correction ratio of the AC component in the resistance group R-M is 100% (standard bias). The correction ratio of the AC component in the resistance group R-L is 90% which is lower than the standard bias. The correction ratio of the AC component in the resistance group R-H is 110% which is greater than the standard bias.

In a case in which the combined resistance is substantially high, the correction ratio (%) of the DC component needs to be greater than that of the AC component. If the same correction ratio (%) is applied to the AC component and the DC component in each of the resistance groups, that is, the correction ratio of the DC component is applied to the AC component, an amount of correction of the AC component is too much, thereby causing electrical discharge and hence resulting in white spots in the image.

In view of the above, according to the present illustrative embodiment, the correction ratio of the AC component is different from that of the DC component. With this configuration, the toner can be transferred well to the recessed portions as well as the projecting portions of the recording medium in accordance with the size and the thickness of the recording medium, and the combined resistance. In other words, good transferability of the toner is achieved at both the recessed portions as well as the projecting portions.

As described above, by applying a different correction ratio to the DC component and to the AC component, proper image transfer can be performed with an optimum DC component and an optimum AC component in accordance with the conditions above.

Furthermore, preferably, when the recording medium is relatively thick and the resistance of the transfer portion is relatively high, an amount of change in the correction ratio of the AC component is less than an amount of change in the correction ratio of the AC component when the recording medium is relatively thin and the resistance of the transfer portion is relatively high. With this configuration, in accordance with the thickness and the resistance, an optimum DC component and AC component can be output.

A description is now provided of experiments performed by the present inventors in which the same correction ratio was applied to the DC component and the AC component in the transfer bias. It is to be noted that the configurations of a test machine and a detection method are the same as that of the illustrative embodiment. Hence, the description thereof is omitted herein.

Comparative Example 1

In the Comparative Example 1, the correction ratio of an environment correction coefficient of the AC component was the same as the correction ratio of the DC component. The correction ratios are shown in TABLE 14. The setting except for the environment correction is the same as Embodiment 1 (shown in TABLES 7 through 10).

TABLE 14

| COMPARATIVE EXAMPLE 1 ENVIRONMENT CORRECTION | | | |
|---|---|---|---|
| | ENVIRONMENT GROUP | | |
| | LL | MM | HH |
| BOTH DC COMPONENT AND AC COMPONENT | 110% | 100% | 90% |

An image was printed under the following conditions in a first illustrative embodiment (Embodiment 1) and the Comparative Example 1.

Printing speed: Standard speed;

Secondary transfer combined resistance group: R-M;

Environment: 10° C., 15% (Environment group: LL), 23° C., 50% (Environment group: MM), and 27° C., 80% (Environment group: HH);

Width of sheet in the main scanning direction: A4-Landscape (297 mm, Size 1);

Sheet: LEATHAC 66 (registered trademark) having a ream weight of 100 kg (a basis weight of approximately 116 gsm), Thickness 1; and Chart: solid image in the color blue on the entire sheet, halftone image in the color cyan on the entire sheet.

TABLES 15 through 17 show correction ratios in each environment. TABLE 18 shows results of the experiments. In TABLE 18, "GOOD" means that a resulting image showed no defect. "POOR" means that the resulting image contained a defect.

TABLE 15

| | | EMBODIMENT 1 | | COMPARATIVE EXAMPLE 1 | |
|---|---|---|---|---|---|
| | | DC COMPONENT | AC COMPONENT | DC COMPONENT | AC COMPONENT |
| ENVIRONMENT GROUP MM | ENVIRONMENT CORRECTION (%) | 100 | 100 | 100 | 100 |
| | LINEAR VELOCITY CORRECTION (%) | 100 | 100 | 100 | 100 |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −50 μA | 7.0 kV | −50 μA | 7.0 kV |

TABLE 16

| | | EMBODIMENT 1 | | COMPARATIVE EXAMPLE 1 | |
|---|---|---|---|---|---|
| | | DC COMPONENT | AC COMPONENT | DC COMPONENT | AC COMPONENT |
| ENVIRONMENT GROUP LL | ENVIRONMENT CORRECTION (%) | 110 | 120 | 110 | 110 |
| | LINEAR VELOCITY CORRECTION (%) | 100 | 100 | 100 | 100 |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −55 μA | 8.4 kV | −55 μA | 7.7 kV |

TABLE 17

| | | EMBODIMENT 1 | | COMPARATIVE EXAMPLE 1 | |
|---|---|---|---|---|---|
| | | DC COMPONENT | AC COMPONENT | DC COMPONENT | AC COMPONENT |
| ENVIRONMENT GROUP HH | ENVIRONMENT CORRECTION (%) | 90 | 80 | 90 | 90 |
| | LINEAR VELOCITY CORRECTION (%) | 100 | 100 | 100 | 100 |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −45 μA | 5.6 kV | −45 μA | 6.3 kV |

TABLE 18

| | | LL | MM | HH |
|---|---|---|---|---|
| SOLID (BLUE) | EMBODIMENT 1 | GOOD | GOOD | GOOD |
| | COMPARATIVE EXAMPLE 1 | POOR | GOOD | GOOD |
| HALFTONE (CYAN) | EMBODIMENT 1 | GOOD | GOOD | GOOD |
| | COMPARATIVE EXAMPLE 1 | GOOD | GOOD | POOR |

In the Embodiment 1 in which the correction ratio of the AC component is different from that of the DC component, the resulting image had no defect. By contrast, in the Comparative Example 1 in which the correction ratio of the AC component was the same as that of the DC component in the environment correction, the AC component was insufficient in the LL environment so that white spots were generated at the recessed portions in the solid image due to insufficient transfer of the toner. In the HH environment, the AC component became excessive, causing electrical discharge in the transfer nip. As a result, white spots were generated in the halftone image. Accordingly, it is confirmed that applying a different correction ratio to the DC component and the AC component in the environment correction is effective.

Comparative Example 2

In a Comparative Example 2, the correction ratio of a linear velocity correction coefficient of the AC component was the same as that of the DC component. The correction ratios are shown in TABLE 19. The setting except for the linear velocity correction is the same as the Embodiment 1 (shown in TABLES 6 and 8 through 10).

TABLE 19

| | COMPARATIVE EXAMPLE 2 LINEAR VELOCITY CORRECTION | | |
|---|---|---|---|
| | STANDARD SPEED | MEDIUM SPEED | SLOW SPEED |
| BOTH DC COMPONENT AND AC COMPONENT | 100% | 70% | 50% |

An image was printed under the following conditions in the Embodiment 1 and the Comparative Example 2.

Secondary transfer combined resistance group: R-M;

Environment: 23° C., 50% (Environment group: MM);

Width of sheet in the main scanning direction: A4-Landscape (297 mm, Size 1);

Sheet 1: LEATHAC 66 (registered trademark) having the ream weight of 130 kg (basis weight of approximately 151 gsm), Thickness 2, with the medium printing speed;

Sheet 2: LAID Unwatermarked Hi White Conqueror, manufactured by Conqueror; having the basis weight of 300 gsm, Thickness 3, with the slow printing speed; and Chart: solid image in the color blue over the sheet, halftone image in the color cyan over the entire sheet.

TABLE 20 shows correction ratios for the medium speed. TABLE 21 shows correction ratios for the slow speed. TABLE 22 shows results of the experiments. In TABLE 22, "GOOD" means that a resulting image showed no defect. "POOR" means that the resulting image contained a defect.

TABLE 20

| | | EMBODIMENT 1 | | COMPARATIVE EXAMPLE 2 | |
|---|---|---|---|---|---|
| | | DC COMPONENT | AC COMPONENT | DC COMPONENT | AC COMPONENT |
| PRINTING SPEED (MEDIUM) | ENVIRONMENT CORRECTION (%) | 100 | 100 | 100 | 100 |
| | LINEAR VELOCITY CORRECTION (%) | 70 | 100 | 70 | 70 |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −35 μA | 7.0 kV | −35 μA | 4.9 kV |

TABLE 21

| | | EMBODIMENT 1 | | COMPARATIVE EXAMPLE 2 | |
|---|---|---|---|---|---|
| | | DC COMPONENT | AC COMPONENT | DC COMPONENT | AC COMPONENT |
| PRINTING SPEED (SLOW) | ENVIRONMENT CORRECTION (%) | 100 | 100 | 100 | 100 |
| | LINEAR VELOCITY CORRECTION (%) | 50 | 100 | 50 | 50 |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −25 μA | 7.0 kV | −25 μA | 3.5 kV |

TABLE 22

| | | MEDIUM SPEED | SLOW |
|---|---|---|---|
| SOLID (BLUE) | EMBODIMENT 1 | GOOD | GOOD |
| | COMPARATIVE EXAMPLE 2 | POOR | POOR |
| HALFTONE (CYAN) | EMBODIMENT 1 | GOOD | GOOD |
| | COMPARATIVE EXAMPLE 2 | GOOD | GOOD |

In the Embodiment 1 in which the correction ratio of the AC component was different from that of the DC component, the resulting image had no defect at all printing speeds. By contrast, in the Comparative Example 2 in which correction ratio of the AC component was the same as that of the DC component in the linear velocity correction, the AC component was insufficient both at the medium printing speed and the slow printing speed. As a result, white spots were generated at the recessed portions in the solid image due to insufficient transfer of the toner. Accordingly, it is confirmed that applying a different correction ratio to the DC component and to the AC component in the linear velocity correction is effective.

Comparative Example 3

In a Comparative Example 3, in the sheet width correction of the sheet size correction, the correction ratio of the AC component was the same as that of the DC component. The correction ratios are shown in TABLE 19. The setting except for the sheet size correction is the same as the Embodiment 1 (shown in TABLES 6 through 9).

An image was printed under the following conditions in the Embodiment 1 and the Comparative Example 3.

Printing speed: Standard speed;

Secondary transfer combined resistance group: R-M;

Environment: 23° C., 50% (Environment group: MM);

Width of sheet in the main scanning direction: A4-Landscape (297 mm, Size 1), A5-Portrait (148.5 mm, Size 3);

Sheet: LEATHAC 66 (registered trademark) having the ream weight of 100 kg (basis weight of 116 gsm), and Thickness 1; and Chart: Solid image in the color blue on the entire sheet, halftone image in the color cyan on the entire sheet.

TABLE 23 shows correction ratios of the Size 1. TABLE 24 shows correction ratios of the Size 3. TABLE 25 shows results of the experiments. In TABLE 25, "GOOD" means that a resulting image showed no defect. "POOR" means that the resulting image contained a defect.

TABLE 23

| | | EMBODIMENT 1 | | COMPARATIVE EXAMPLE 3 | |
|---|---|---|---|---|---|
| | | DC COMPONENT | AC COMPONENT | DC COMPONENT | AC COMPONENT |
| RESISTANCE GROUP R-M | ENVIRONMENT CORRECTION (%) | 100 | 100 | 100 | 100 |
| THICKNESS 1 SIZE 1 | LINEAR VELOCITY CORRECTION (%) | 100 | 100 | 100 | 100 |

TABLE 23-continued

| | | EMBODIMENT 1 | | COMPARATIVE EXAMPLE 3 | |
|---|---|---|---|---|---|
| | | DC COMPONENT | AC COMPONENT | DC COMPONENT | AC COMPONENT |
| | SHEET SIZE CORRECTION (%) | 100 | 100 | 100 | 100 |
| | STANDARD VALUE | −50 μA | 7.0 kV | −50 μA | 7.0 kV |
| | ADJUSTMENT VALUE | −50 μA | 7.0 kV | −50 μA | 7.0 kV |

TABLE 24

| | | EMBODIMENT 1 | | COMPARATIVE EXAMPLE 3 | |
|---|---|---|---|---|---|
| | | DC COMPONENT | AC COMPONENT | DC COMPONENT | AC COMPONENT |
| RESISTANCE GROUP R-M THICKNESS 1 SIZE 3 | ENVIRONMENT CORRECTION (%) | 100 | 100 | 100 | 100 |
| | LINEAR VELOCITY CORRECTION (%) | 100 | 100 | 100 | 100 |
| | SHEET SIZE CORRECTION (%) | 140 | 100 | 140 | 140 |
| | STANDARD VALUE | −50 μA | 7.0 kV | −50 μA | 7.0 kV |
| | ADJUSTMENT VALUE | −70 μA | 7.0 kV | −70 μA | 9.8 kV |

TABLE 25

| | | SIZE 1 | SIZE 3 |
|---|---|---|---|
| SOLID (BLUE) | EMBODIMENT 1 | GOOD | GOOD |
| | COMPARATIVE EXAMPLE 3 | GOOD | GOOD |
| HALFTONE (CYAN) | EMBODIMENT 1 | GOOD | GOOD |
| | COMPARATIVE EXAMPLE 3 | GOOD | POOR |

TABLE 26

| GROUP: R-M SHEET SIZE 3 | | |
|---|---|---|
| THICKNESS | DC COMPONENT | AC COMPONENT |
| THICKNESS 1 | 140% | 140% |
| THICKNESS 2 | 160% | 160% |
| THICKNESS 3 | 180% | 180% |

In the Embodiment 1 in which the correction ratio of the AC component was different from that of the DC component, the resulting image had no defect for all sizes. By contrast, in the Comparative Example 3 in which the correction ratio of the AC component in the sheet size correction was the same as that of the DC component, the resulting image formed on the recording medium of the Size 1 had no defect because the sheet correction ratio was 100%. However, the halftone image formed on the recording medium of Size 3 had defects such as white spots because the AC component became excessive, hence causing electrical discharge in the transfer nip. As described above, it is confirmed that applying a different correction ratio to the DC component and the AC component in the sheet width correction of the sheet size correction is effective.

Comparative Example 4

In a Comparative Example 4, in the sheet thickness correction of the sheet size correction, the correction ratio of the AC component was the same as that of the DC component. The correction ratios are shown in TABLE 26. The setting except for the sheet size correction is the same as the Embodiment 1 (shown in TABLES 6 through 9).

An image was printed under the following conditions in the Embodiment 1 and the Comparative Example 4.

Secondary transfer combined resistance group: R-M;

Environment: 23° C., 50% (Environment Group: MM);

Width of sheet in the main scanning direction: A5-Portrait (148.5 mm, Size 3);

Sheet 1: LEATHAC 66 (registered trademark) having the ream weight of 100 kg (basis weight of approximately 116 gsm), Thickness 1, with the standard printing speed;

Sheet 2: LEATHAC 66 (registered trademark) having the ream weight of 130 kg (basis weight of approximately 151 gsm), Thickness 2, with the medium printing speed;

Sheet 3: LAID Unwatermarked Hi White Conqueror, manufactured by Conqueror having the basis weight of 300 gsm, Thickness 3, with the slow printing speed;

Chart: Solid image in the color blue on the entire sheet, halftone image in the color cyan on the entire sheet.

TABLE 27 shows correction ratios for the thickness 1. TABLE 28 shows correction ratios for the thickness 2. TABLE 29 shows correction ratios for the thickness 3. TABLE 30 shows results of the experiments. In TABLE 30, "GOOD" means that the resulting image showed no defect. "POOR" means that the resulting image contained a defect.

TABLE 27

| | | EMBODIMENT 1 | | COMPARATIVE EXAMPLE 4 | |
|---|---|---|---|---|---|
| | | DC COMPONENT | AC COMPONENT | DC COMPONENT | AC COMPONENT |
| RESISTANCE GROUP R-M THICKNESS 1 SIZE 3 | ENVIRONMENT CORRECTION (%) | 100 | 100 | 100 | 100 |
| | LINEAR VELOCITY CORRECTION (%) | 100 | 100 | 100 | 100 |
| | SHEET SIZE CORRECTION (%) | 140 | 100 | 140 | 140 |
| | STANDARD VALUE | −50 μA | 7.0 kV | −50 μA | 7.0 kV |
| | ADJUSTMENT VALUE | −70 μA | 7.0 kV | −70 μA | 9.8 kV |

TABLE 28

| | | EMBODIMENT 1 | | COMPARATIVE EXAMPLE 4 | |
|---|---|---|---|---|---|
| | | DC COMPONENT | AC COMPONENT | DC COMPONENT | AC COMPONENT |
| RESISTANCE GROUP R-M THICKNESS 2 SIZE 3 | ENVIRONMENT CORRECTION (%) | 100 | 100 | 100 | 100 |
| | LINEAR VELOCITY CORRECTION (%) | 70 | 100 | 70 | 100 |
| | SHEET SIZE CORRECTION (%) | 160 | 100 | 160 | 160 |
| | STANDARD VALUE | −50 μA | 7.0 kV | −50 μA | 7.0 kV |
| | ADJUSTMENT VALUE | −56 μA | 7.0 kV | −56 μA | 11.2 kV |

TABLE 29

| | | EMBODIMENT 1 | | COMPARATIVE EXAMPLE 4 | |
|---|---|---|---|---|---|
| | | DC COMPONENT | AC COMPONENT | DC COMPONENT | AC COMPONENT |
| RESISTANCE GROUP R-M THICKNESS 3 SIZE 3 | ENVIRONMENT CORRECTION (%) | 100 | 100 | 100 | 100 |
| | LINEAR VELOCITY CORRECTION (%) | 50 | 100 | 50 | 100 |
| | SHEET SIZE CORRECTION (%) | 180 | 100 | 180 | 180 |
| | STANDARD VALUE | −50 μA | 7.0 kV | −50 μA | 7.0 kV |
| | ADJUSTMENT VALUE | −45 μA | 7.0 kV | −45 μA | 12.6 kV |

TABLE 30

| | | THICKNESS 1 | THICKNESS 2 | THICKNESS 3 |
|---|---|---|---|---|
| SOLID (BLUE) | EMBODIMENT 1 | GOOD | GOOD | GOOD |
| | COMPARATIVE EXAMPLE 4 | GOOD | GOOD | GOOD |
| HALF-TONE (CYAN) | EMBODIMENT 1 | GOOD | GOOD | GOOD |
| | COMPARATIVE EXAMPLE 4 | POOR | POOR | POOR |

In the Embodiment 1 in which the correction ratio of the AC component was different from that of the DC component, the resulting image had no defect for all thicknesses. By contrast, in the Comparative Example 4 in which the correction ratio of the AC component in the sheet size correction was the same as that of the DC component, the halftone images formed on the recording media of thicknesses 1 through 3 had defects such as white spots because the AC component became excessive, hence causing electrical discharge in the transfer nip for all thicknesses. As described above, it is confirmed that applying a different correction ratio to the DC component and to the AC component in the sheet thickness correction of the sheet size correction is effective.

Comparative Example 5

In a Comparative Example 5, in the resistance group correction of the sheet size correction, the correction ratios of the AC component for the Sheet 1 and the Size 3 were the same as that of the DC component. The correction ratios are shown in TABLE 31. The setting except for the sheet size correction is the same as the Embodiment 1 (shown in TABLES6 through 9). It is to be noted that the secondary transfer combined resistance was adjusted using secondary-transfer back surface rollers having a different volume resistivity to obtain a detection voltage of 0.8 kV (resistant group R-L), a detection voltage of 1.5 kV (resistant group R-M), and a detection voltage of 3.5 kV (resistant group R-H).

TABLE 31

| | THICKNESS 1 SHEET SIZE 3 | |
|---|---|---|
| RESISTANCE GROUP | DC COMPONENT | AC COMPONENT |
| R-L | 190% | 190% |
| R-M | 140% | 140% |
| R-H | 110% | 110% |

An image was printed under the following conditions in the Embodiment 1 and the Comparative Example 5.

Printing speed: Standard speed;

Secondary transfer combined resistance group: R-L, R-M, and R-H;

Environment: 23° C., 50% (Environment Group: MM);

Width of sheet in the main scanning direction: A5-Portrait (148.5 mm, Size 3);

Sheet: LEATHAC 66 (registered trademark) having the ream weight of 100 kg (basis weight of 116 gsm), and Thickness 1;

Chart: Solid image in the color blue on the entire sheet, and halftone image in the color cyan on the entire sheet.

TABLE 32 shows correction ratios of the resistance group R-L. TABLE 33 shows correction ratios of the resistance group R-M. TABLE 34 shows correction ratios of the resistance group R-H. TABLE 35 shows results of the experiments. In TABLE 35, "GOOD" means that the resulting image showed no defect. "POOR" means that the resulting image contained a defect.

TABLE 32

| | | EMBODIMENT 1 | | COMPARATIVE EXAMPLE 5 | |
|---|---|---|---|---|---|
| | | DC COMPONENT | AC COMPONENT | DC COMPONENT | AC COMPONENT |
| RESISTANCE GROUP R-L THICKNESS 1 SIZE 3 | ENVIRONMENT CORRECTION (%) | 100 | 100 | 100 | 100 |
| | LINEAR VELOCITY CORRECTION (%) | 100 | 100 | 100 | 100 |
| | SHEET SIZE CORRECTION (%) | 190 | 90 | 190 | 190 |
| | STANDARD VALUE | −50 μA | 7.0 kV | −50 μA | 7.0 kV |
| | ADJUSTMENT VALUE | −95 μA | 6.3 kV | −95 μA | 13.3 kV |

TABLE 33

| | | EMBODIMENT 1 | | COMPARATIVE EXAMPLE 5 | |
|---|---|---|---|---|---|
| | | DC COMPONENT | AC COMPONENT | DC COMPONENT | AC COMPONENT |
| RESISTANCE GROUP R-M THICKNESS 1 SIZE 3 | ENVIRONMENT CORRECTION (%) | 100 | 100 | 100 | 100 |
| | LINEAR VELOCITY CORRECTION (%) | 100 | 100 | 100 | 100 |
| | SHEET SIZE CORRECTION (%) | 140 | 100 | 140 | 140 |
| | STANDARD VALUE | −50 μA | 7.0 kV | −50 μA | 7.0 kV |
| | ADJUSTMENT VALUE | −70 μA | 7.0 kV | −70 μA | 9.8 kV |

TABLE 34

| | | EMBODIMENT 1 | | COMPARATIVE EXAMPLE 5 | |
|---|---|---|---|---|---|
| | | DC COMPONENT | AC COMPONENT | DC COMPONENT | AC COMPONENT |
| RESISTANCE GROUP R-H THICKNESS 1 SIZE 3 | ENVIRONMENT CORRECTION (%) | 100 | 100 | 100 | 100 |
| | LINEAR VELOCITY CORRECTION (%) | 100 | 100 | 100 | 100 |

TABLE 34-continued

| | EMBODIMENT 1 | | COMPARATIVE EXAMPLE 5 | |
|---|---|---|---|---|
| | DC COMPONENT | AC COMPONENT | DC COMPONENT | AC COMPONENT |
| SHEET SIZE CORRECTION (%) | 110 | 110 | 110 | 110 |
| STANDARD VALUE | −50 μA | 7.0 kV | −50 μA | 7.0 kV |
| ADJUSTMENT VALUE | −55 μA | 7.7 kV | −55 μA | 7.7 kV |

TABLE 35

| | | R-L | R-M | R-H |
|---|---|---|---|---|
| SOLID (BLUE) | EMBODIMENT 1 | GOOD | GOOD | GOOD |
| | COMPARATIVE EXAMPLE 5 | GOOD | GOOD | GOOD |
| HALFTONE (CYAN) | EMBODIMENT 1 | GOOD | GOOD | GOOD |
| | COMPARATIVE EXAMPLE 5 | POOR | POOR | GOOD |

In the Embodiment 1 in which the correction ratio of the AC component was different from that of the DC component, the resulting image had no defect for all the resistance groups. By contrast, in the Comparative Example 5 in which the correction ratio of the AC component in the sheet size correction was the same as that of the DC component, the halftone images in the resistance group R-H had no defect, but in the resistance groups R-L and R-M the halftone images had defects such as white spots because the AC component became excessive, hence causing electrical discharge in the transfer nip. As described above, it is confirmed that applying a different correction ratio to the DC component and to the AC component in the resistance group correction of the sheet size correction is effective.

Next, a description is provided of a second illustrative embodiment (Embodiment 2) in which the environment groups are broken down into further smaller groups and the environment correction is also broken down into more detailed groups. The setting except for the environment groups and the environment correction is the same as Embodiment 1. Thus, the description is provided of the difference.

Embodiment 2

TABLE 36 shows an example of the environment groups based on the absolute humidity. TABLE 37 shows the correction ratios of the DC component and the AC component for each environment group.

Similar to the Embodiment 1, even when the environment groups are broken down into smaller groups, the correction ratios in the low-temperature groups are set greater than the standard ratio in the normal environment group, and the correction ratios in the high-temperature groups are set less than the standard ratio in the normal environment group Similar to the Embodiment 1, according to the present illustrative embodiment, the correction ratio of the AC component is greater than the correction ratio of the DC component. With this configuration, the same effect as that of the Embodiment 1 can be achieved in the Embodiment 2. Furthermore, more detail environment groups, here, 6 groups compared with 3 groups of the Embodiment 1, can provide reliably an optimum DC component and AC component even when there is a slight change in the environment.

TABLE 36

| ENVIRONMENT GROUP | ABSOLUTE HUMIDITY D (g/m^3) |
|---|---|
| LLL | D < 2.5 |
| LL | 2.5 ≤ D < 5.0 |
| ML | 5.0 ≤ D < 8.5 |
| MM | 8.5 ≤ D < 15.0 |
| MH | 15.0 ≤ D < 24.0 |
| HH | 24.0 ≤ D |

TABLE 37

| ENVIRONMENT CORRECTION | | | | | | |
|---|---|---|---|---|---|---|
| | ENVIRONMENT GROUP | | | | | |
| | LLL | LL | ML | MM | MH | HH |
| DC COMPONENT | 110% | 105% | 100% | 100% | 90% | 85% |
| AC COMPONENT | 120% | 115% | 110% | 100% | 85% | 65% |

Next, a description is provided of a third illustrative embodiment (Embodiment 3) in which the thickness and the combined resistance are broken down into further smaller groups and more detailed correction ratios are provided. The setting except for the sheet thickness groups and the combined resistance at the secondary transfer is the same as Embodiment 1. Thus, the description is provided only of the difference.

Embodiment 3

TABLE 38 shows an example of the sheet thickness groups. TABLE 39 shows an example of the groups of the combined resistance at the secondary transfer portion. It is to be noted that the method for detecting the combined resistance at the secondary transfer portion is similar to the Embodiment 1. "R-L2" represents a low combined resistance. "R-M" represents a medium resistance. The combined resistance gets higher toward "R-H3".

TABLE 38

| | BASIS WEIGHT |
|---|---|
| THICKNESS 1 | 52.3 gsm~63.0 gsm |
| THICKNESS 2 | 63.1 gsm~80.0 gsm |
| THICKNESS 3 | 80.1 gsm~105.0 gsm |
| THICKNESS 4 | 105.1 gsm~163.0 gsm |
| THICKNESS 5 | 163.1 gsm~220.0 gsm |
| THICKNESS 6 | 220.1 gsm~256.0 gsm |
| THICKNESS 7 | 256.1 gsm~300.0 gsm |

TABLE 39

| | DETECTED VOLTAGE: V(kV) |
|---|---|
| R-L2 | V ≤ 0.5 |
| R-L1 | 0.5 < V ≤ 1.0 |
| R-M | 1.0 < V ≤ 1.5 |
| R-H1 | 1.5 < V ≤ 2.5 |
| R-H2 | 2.5 < V ≤ 4.0 |
| R-H3 | 4.0 < V |

TABLE 40 shows correction ratios of the AC component in the sheet size correction in accordance with the more detailed sheet thickness groups and the combined ratio groups described above.

TABLE 40

| | THICKNESS 1 | THICKNESS 2 | THICKNESS 3 | THICKNESS 4 | THICKNESS 5 | THICKNESS 6 | THICKNESS 7 |
|---|---|---|---|---|---|---|---|
| R-L2 | 78% | 78% | 79% | 80% | 82% | 83% | 85% |
| R-L1 | 90% | 91% | 91% | 91% | 92% | 93% | 93% |
| R-M | 100% | 100% | 100% | 100% | 100% | 100% | 100% |
| R-H1 | 111% | 111% | 111% | 110% | 109% | 108% | 108% |
| R-H2 | 134% | 133% | 132% | 130% | 127% | 125% | 123% |
| R-H3 | 154% | 153% | 152% | 149% | 144% | 140% | 137% |

As described in the Embodiment 1, the AC component of the superimposed bias is under constant voltage control. Thus, the same correction ratio is employed for the sheet sizes 1 through 3. According to the Embodiment 3, the correction ratios of the AC component in the environment group R-M which is the center of the combined resistance are standardized such that the correction ratio is 100%. In the Embodiment 1, if the AC component is in the same resistance group, it is still effective when the same correction ratio is applied regardless of the thickness of the recording medium. However, for a higher quality image, preferably, the correction ratio is changed depending on the thickness of the recording medium.

In this case, for a relatively thin recording medium, a degree by which the correction ratio in the sheet size correction is changed in accordance with a change in the resistance is configured large. For a relatively thick recording medium, a degree by which the correction ratio in the sheet size correction is changed in accordance with a change in the resistance is configured small. This is because the AC component is influenced by the change in the combined resistance to some extent, more specifically, the resistance of the secondary-transfer back surface roller. In other words, the resistance of a relatively thick recording medium is relatively high so that there is less influence of the resistance of the secondary-transfer back surface roller. Hence, only a small amount of change is necessary for the correction ratio in the sheet size correction.

By contrast, the resistance of a relatively thin recording medium is relatively low so that the influence of the secondary-transfer back surface roller is significant. Hence, the correction ratio in the sheet size correction needs to be changed by a large degree.

TABLES 41 through 43 show correction ratios of the DC component in the sheet size correction in accordance with the detailed sheet thickness groups and the combined resistance groups.

According to the present illustrative embodiment, more detailed correction is made to the DC component based on the Embodiment 1. However, the direction of correction is the same as the Embodiment 1. Thus, the description thereof is omitted herein. In this configuration, the same effect as that of the Embodiment 1 can be achieved in the Embodiment 3. Furthermore, the detailed sheet correction groups can provide reliably an optimum DC component and AC component even when there is a slight change in the thickness of the recording medium and the combined resistance.

TABLE 41

| DC COMPONENT: SIZE 1 | | | | | | | |
|---|---|---|---|---|---|---|---|
| | THICKNESS 1 | THICKNESS 2 | THICKNESS 3 | THICKNESS 4 | THICKNESS 5 | THICKNESS 6 | THICKNESS 7 |
| R-L2 | 105% | 105% | 105% | 106% | 107% | 109% | 110% |
| R-L1 | 103% | 103% | 103% | 104% | 105% | 106% | 107% |
| R-M | 102% | 102% | 102% | 103% | 103% | 104% | 105% |
| R-H1 | 101% | 101% | 102% | 102% | 102% | 103% | 104% |
| R-H2 | 101% | 101% | 101% | 101% | 101% | 102% | 102% |
| R-H3 | 100% | 100% | 100% | 100% | 100% | 100% | 100% |

TABLE 42

| DC COMPONENT: SIZE 2 | | | | | | | |
|---|---|---|---|---|---|---|---|
| | THICKNESS 1 | THICKNESS 2 | THICKNESS 3 | THICKNESS 4 | THICKNESS 5 | THICKNESS 6 | THICKNESS 7 |
| R-L2 | 140% | 150% | 160% | 170% | 185% | 200% | 220% |
| R-L1 | 130% | 140% | 150% | 160% | 170% | 180% | 190% |
| R-M | 120% | 125% | 130% | 130% | 135% | 140% | 140% |
| R-H1 | 110% | 110% | 115% | 120% | 125% | 127% | 130% |
| R-H2 | 107% | 107% | 110% | 115% | 115% | 117% | 120% |
| R-H3 | 105% | 105% | 105% | 110% | 110% | 115% | 115% |

TABLE 43

| DC COMPONENT: SIZE 3 | | | | | | | |
|---|---|---|---|---|---|---|---|
| | THICKNESS 1 | THICKNESS 2 | THICKNESS 3 | THICKNESS 4 | THICKNESS 5 | THICKNESS 6 | THICKNESS 7 |
| R-L2 | 190% | 200% | 220% | 240% | 260% | 280% | 300% |
| R-L1 | 160% | 170% | 180% | 200% | 210% | 220% | 250% |
| R-M | 140% | 150% | 160% | 170% | 180% | 190% | 200% |
| R-H1 | 130% | 135% | 140% | 150% | 160% | 170% | 180% |
| R-H2 | 120% | 128% | 130% | 135% | 140% | 145% | 150% |
| R-H3 | 110% | 110% | 120% | 120% | 120% | 130% | 130% |

With reference to FIGS. 26 through 32, a description is provided of variations of the transfer bias supply mechanism.

Figure 26:
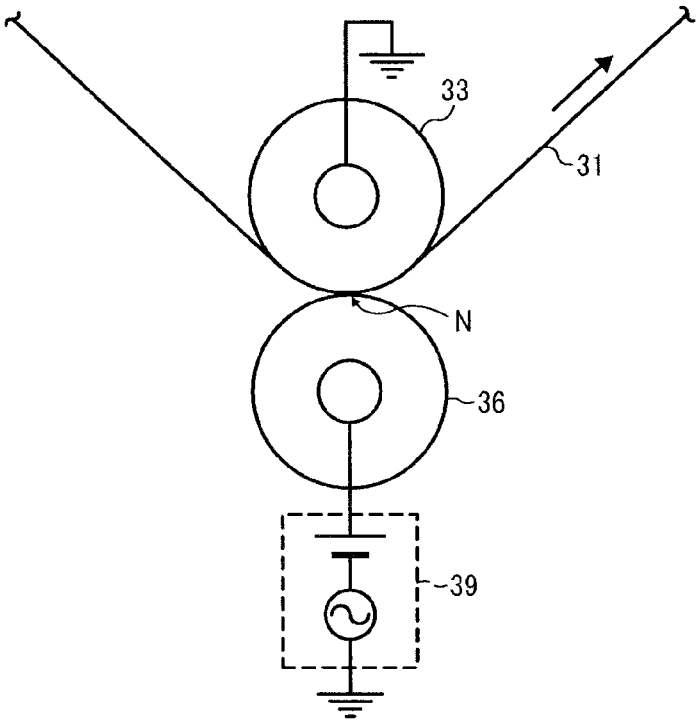
FIG. 26 is a schematic diagram illustrating a variation of a secondary transfer bias application.

FIGS. 26 through 32 are schematic diagrams illustrating variations of the transfer bias supply mechanism. In FIG. 26, a secondary-transfer back surface roller 33 is grounded while the superimposed bias output from a power source 39 is applied to a nip forming roller 36. In this case, the polarity of the DC voltage is different from the illustrative embodiment of FIG. 4. More specifically, as illustrated in FIG. 26, in a case in which the secondary-transfer back surface roller 33 is grounded and the superimposed bias is applied to the nip forming roller 36, the DC voltage having the positive polarity which is opposite that of toner is used so that the time-averaged potential of the superimposed bias has the positive polarity opposite that of the toner.

Figure 27:
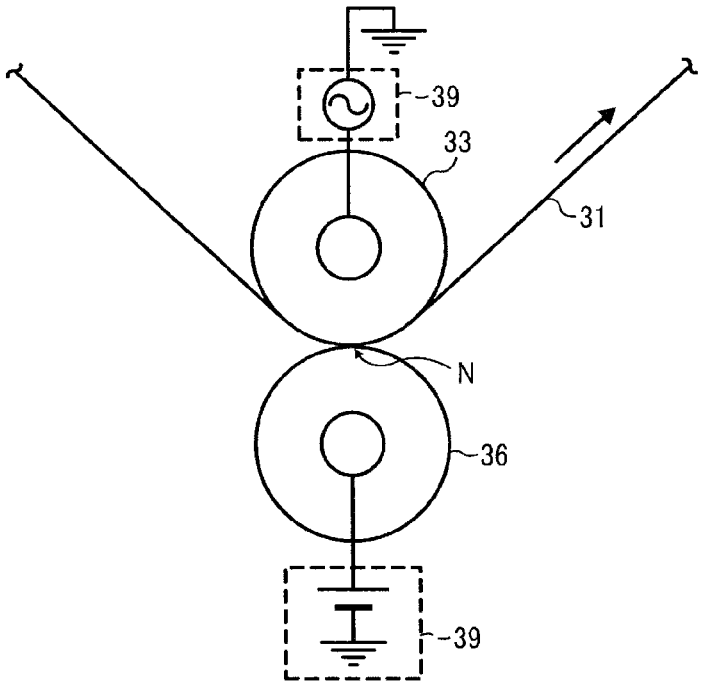
FIG. 27 is a schematic diagram illustrating another variation of the secondary transfer bias application.
Figure 28:
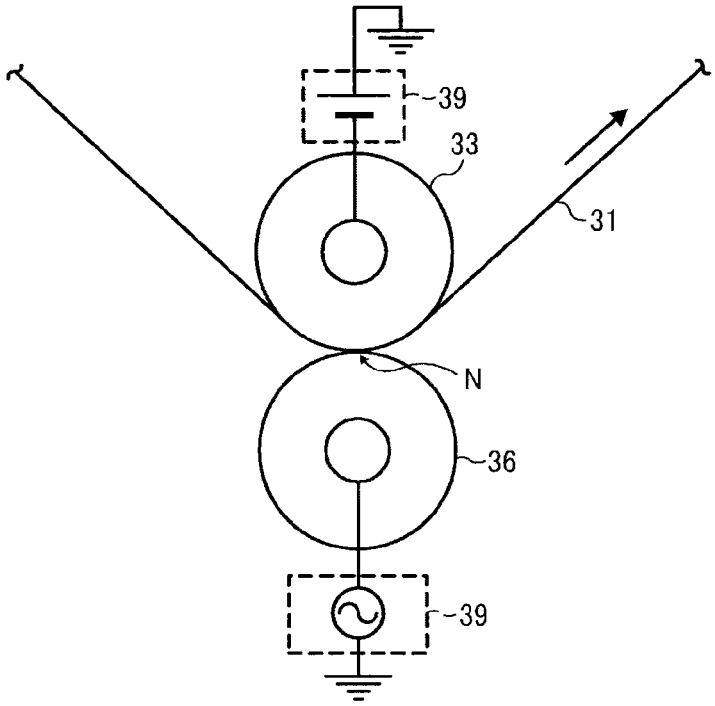
FIG. 28 is a schematic diagram illustrating another variation of the secondary transfer bias application.

FIGS. 27 and 28 show a case in which the DC voltage is supplied from the power source 39 to one of the secondary-transfer back surface roller 33 and the nip forming roller 36, and the AC voltage is supplied from the power source 39 to the other roller, instead of supplying one of the secondary-transfer back surface roller 33 and the nip forming roller 36 with the superimposed bias.

Figure 29:
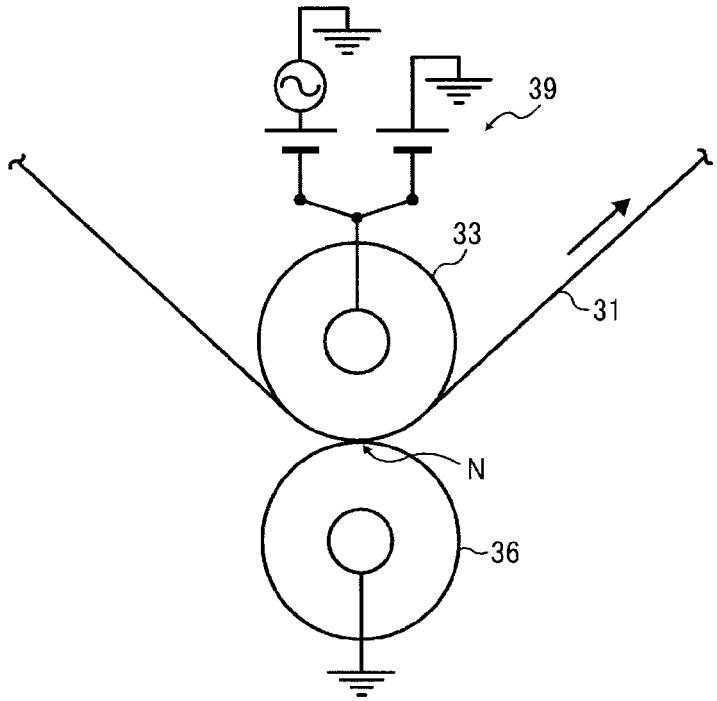
FIG. 29 is a schematic diagram illustrating another variation of the secondary transfer bias application.
Figure 30:
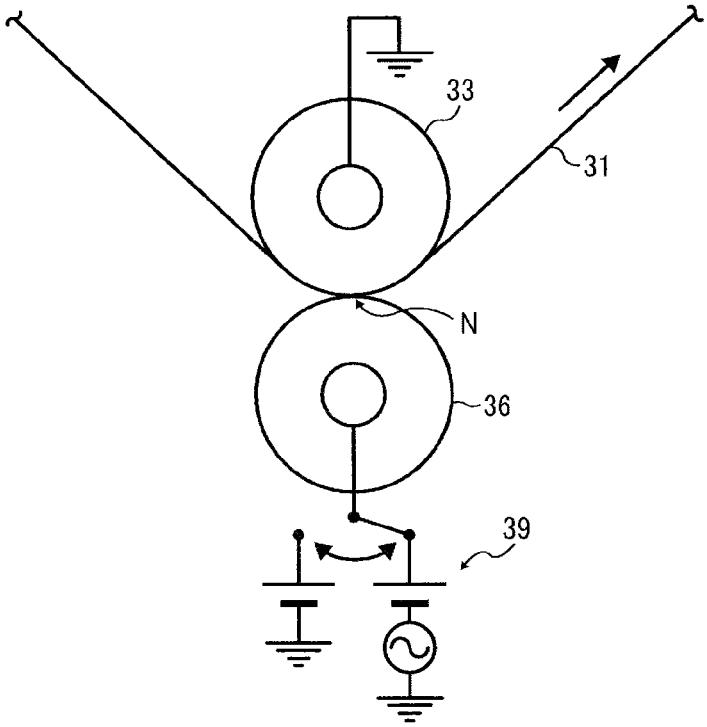
FIG. 30 is a schematic diagram illustrating another variation of the secondary transfer bias application.

FIGS. 29 and 30 show a case in which the power source 39 can switch between a combination of the DC voltage and the AC voltage, and the DC voltage, and supply the voltage to one of the secondary-transfer back surface roller 33 and the nip forming roller 36. More specifically, in FIG. 29 the power source 39 switches the voltage between the combination of the DC voltage and the AC voltage, and the DC voltage, and supplies the voltage to the secondary-transfer back surface roller 33. In FIG. 30, the power source 39 switches the voltage between the combination of the DC voltage and the AC voltage, and the DC voltage, and supplies the voltage to the nip forming roller 36.

Figure 31:
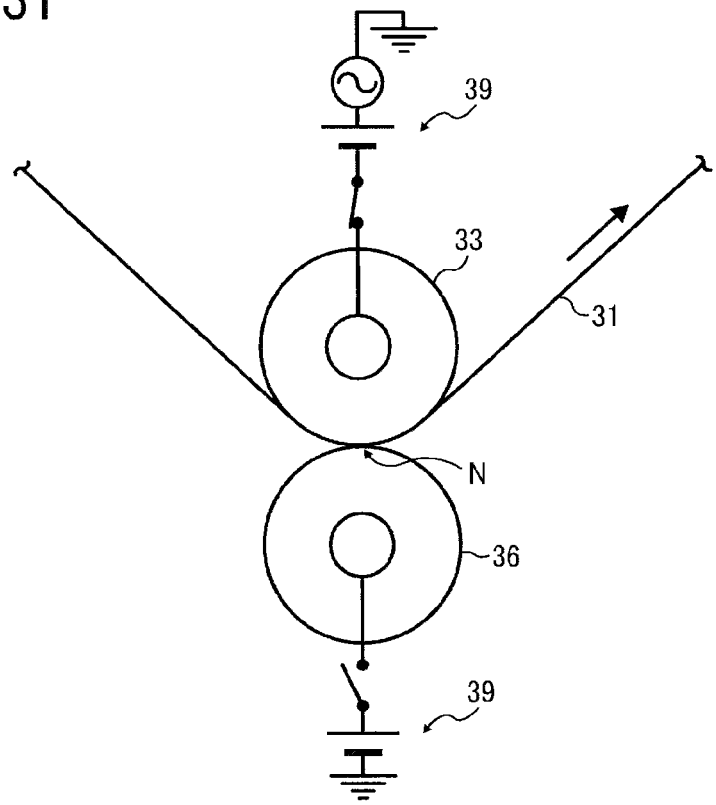
FIG. 31 is a schematic diagram illustrating another variation of the secondary transfer bias application.
Figure 32:
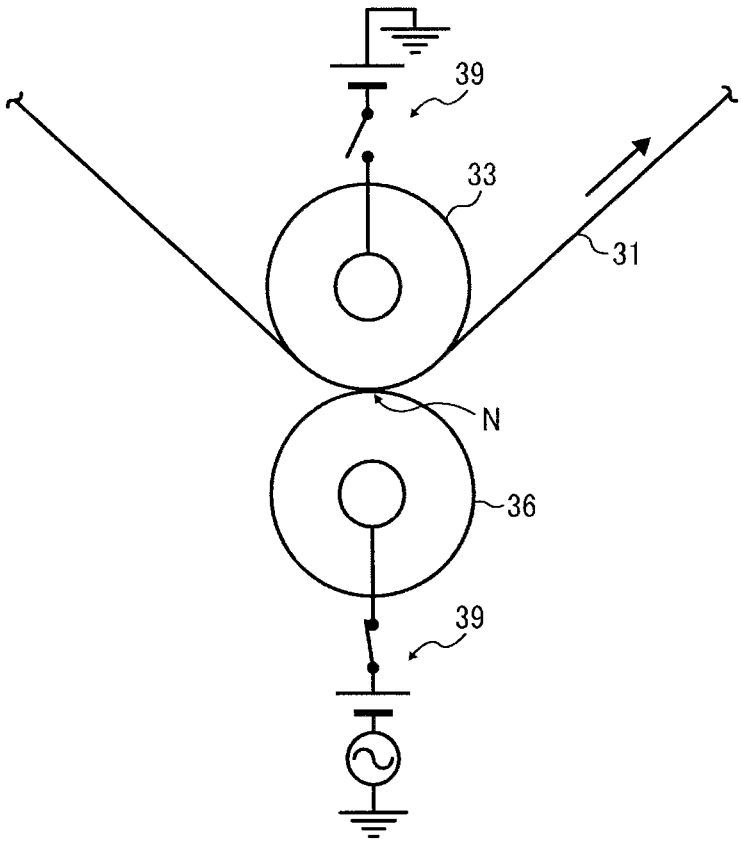
FIG. 32 is a schematic diagram illustrating another variation of the secondary transfer bias application.

FIGS. 31 and 32 show a case in which the combination of the DC voltage and the AC voltage can be supplied to one of the secondary-transfer back surface roller 33 and the nip forming roller 36, and the DC voltage can be supplied to the other roller. More specifically, in FIG. 31, the combination of the DC voltage and the AC voltage can be supplied to the secondary-transfer back surface roller 33, and the DC voltage can be supplied to the nip forming roller 36. In FIG. 32, the DC voltage can be supplied to the secondary-transfer back surface roller 33, and the combination of the DC voltage and the AC voltage can be supplied to the nip forming roller 36.

As described above, there is a variety of ways in which the secondary transfer bias is applied to the secondary transfer nip. Thus, depending on the secondary transfer bias application, a proper power source may be selected. For example, a power source, such as the power source 39, capable of supplying the combination of the DC voltage and the AC voltage, may be employed.

Alternatively, the power source capable of supplying the DC voltage and the AC voltage independently may be employed. Still alternatively, a single power source capable of switching application of the bias between the combination of the DC voltage and the AC voltage, and the DC voltage may be employed. The power source 39 for the secondary transfer bias includes a first mode in which the power source 39 outputs only the DC voltage and a second mode in which the power source 39 outputs a superimposed voltage including the AC voltage superimposed on the DC voltage. The first mode and the second mode are switchable.

According to the illustrative embodiments shown in FIG. 4 and FIGS. 26 through 28, the first mode and the second mode can be switched by turning on and off the output of the AC voltage. According to the illustrative embodiments shown in FIGS. 29 through 32, a plurality of power sources (here, two power sources) is employed and switched by a switching device such as a relay. By switching between the two power sources, the first mode and the second mode may be selectively switched.

With reference to FIGS. 33 through 37, a description is provided of variations of the transfer mechanism.

The present invention can be applied to the configurations illustrated in FIGS. 33 through 37.

Figure 33:
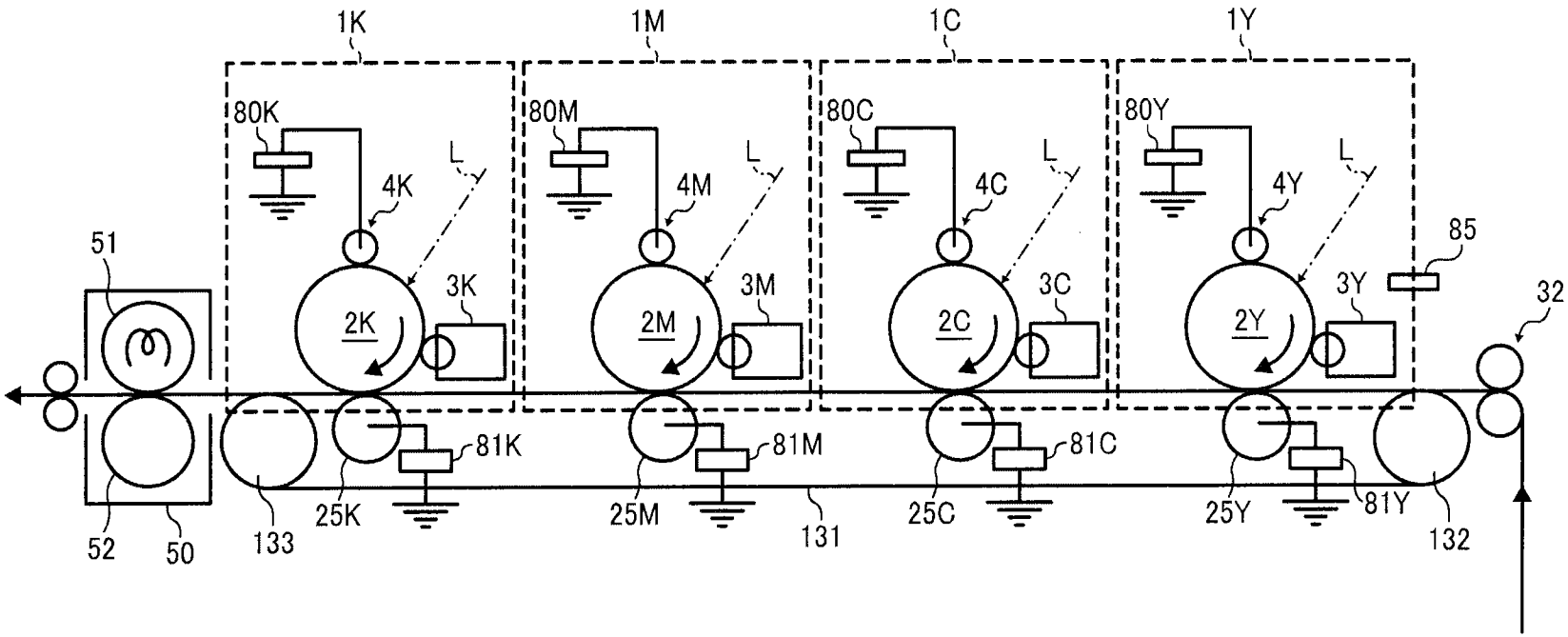
FIG. 33 is a cross-sectional diagram schematically illustrating a color printer of a direct transfer method as an example of the image forming apparatus according to an illustrative embodiment of the invention.

FIG. 33 shows a transfer portion of an image forming apparatus employing a direct transfer method. More specifically, in the image forming apparatus of the direct transfer method as illustrated in FIG. 33, a recording medium is fed onto a conveyance belt 131 by a sheet feed roller 32, and toner images on photosensitive drums 2Y, 2C, 2M, and 2K (collectively referred to as photosensitive drums 2) are transferred directly onto the recording medium by transfer rollers 25Y, 25C, 25M, and 25K (collectively referred to as transfer rollers 25), respectively, such that they are superimposed one atop the other, thereby forming a composite toner image. Subsequently, the composite toner image is fixed by a fixing device 50.

The conveyance belt 131 is formed into a loop and entrained about support rollers 132 and 133. The transfer rollers 25Y, 25C, 25M, and 25K are disposed opposite the photosensitive drums 2Y, 2C, 2M, and 2K, respectively, via the conveyance belt 131, thereby forming transfer portions. A transfer bias is applied to the transfer rollers 25Y, 25C, 25M, and 25K by power sources 81Y, 81C, 81M, and 81K (collectively referred to as power sources 81), respectively.

Each of the power sources 81 includes two power sources: a DC power source and an AC power source. The DC power source of the power source 81 applies a DC bias. The AC power source applies an AC bias (AC-DC superimposed bias). The power sources 81 can switch the transfer bias between the DC bias and the superimposed bias. According to the present illustrative embodiment, a correction ratio different from that of the DC component is applied to the AC component. With this configuration, the same effect as that of the foregoing embodiments can be achieved. The description of the transfer bias is provided above. Thus, the description thereof is omitted herein.

Figure 34:
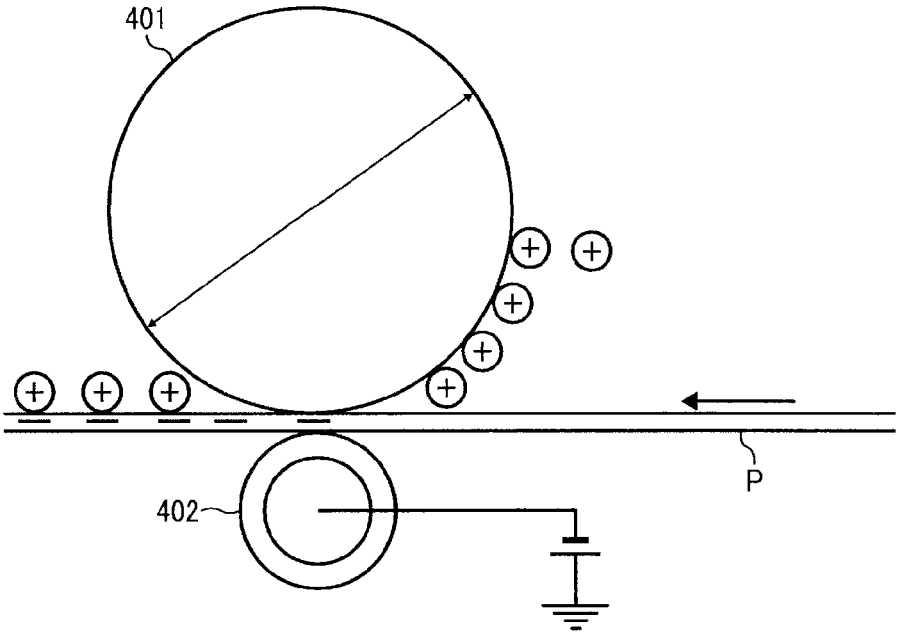
FIG. 34 is a cross-sectional diagram schematically illustrating a monochrome printer of the direct transfer method as an example of the image forming apparatus according to an illustrative embodiment of the invention.

FIG. 34 is a cross-sectional diagram schematically illustrating a monochrome printer of a direct transfer method as an example of an image forming apparatus. As illustrated in FIG. 34, a medium-resistant transfer roller 402 contacts a photosensitive drum 401. A bias is applied to the transfer roller 402 to transfer toner from the photosensitive drum 401 to a recording medium (transfer sheet) P while the recording medium P is transported.

The photosensitive drum 401 is not limited to a drum. A belt-type photosensitive member may be employed. The transfer roller 402 may include a foam layer (elastic layer) or a surface layer coated with elastic material such as foam.

Figure 35:
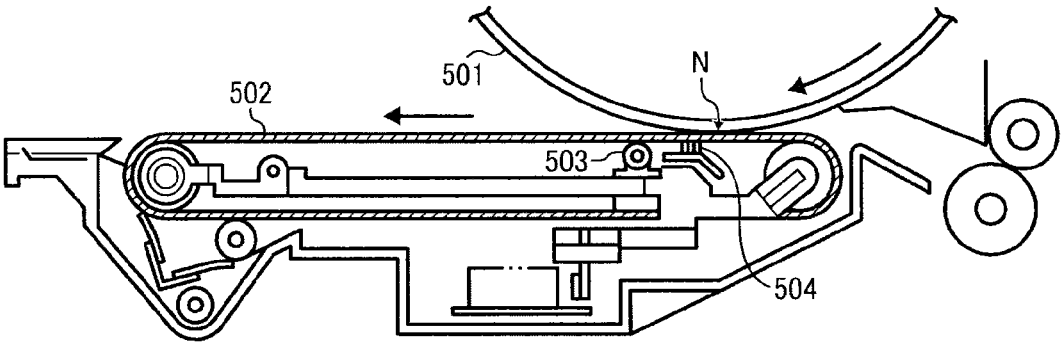
FIG. 35 is a schematic diagram illustrating an image forming apparatus using a transfer conveyance belt.

As illustrated in FIG. 35, a medium-resistant transfer conveyance belt 502 contacts a photosensitive drum 501. A bias is applied to the transfer conveyance belt 502 to transfer toner from the photosensitive drum 501 to the recording medium while transporting the recording medium. The bias is applied to the transfer conveyance belt 502 by a transfer bias roller 503 and a bias application brush 504. The transfer bias roller 503 and the bias application brush 504 are connected to a high voltage power source. The photosensitive drum 401 is not limited to a drum. A belt-type photosensitive member may be employed. The transfer bias roller 503 may include a foam layer (elastic layer) or a surface layer coated with elastic material such as foam.

In FIG. 35 a roller-type bias application device (here, the transfer bias roller 503) and a brush-type bias application device (here, the bias application brush 504) are employed as bias application devices. Alternatively, both of the bias application devices may be rollers or brushes. The transfer bias devices may be disposed below the transfer nip N or near the transfer nip N.

Alternatively, only one bias application device may be employed. In such a case, the bias application device may be either a roller or a brush. The bias application device may be disposed at the place shown in FIG. 35, or below the transfer nip N or near the transfer nip N. Alternatively, as a bias application device, a contact-free bias application device may be employed. In this case, a charger is disposed inside the loop formed by the transfer conveyance belt 502.

Figure 36:
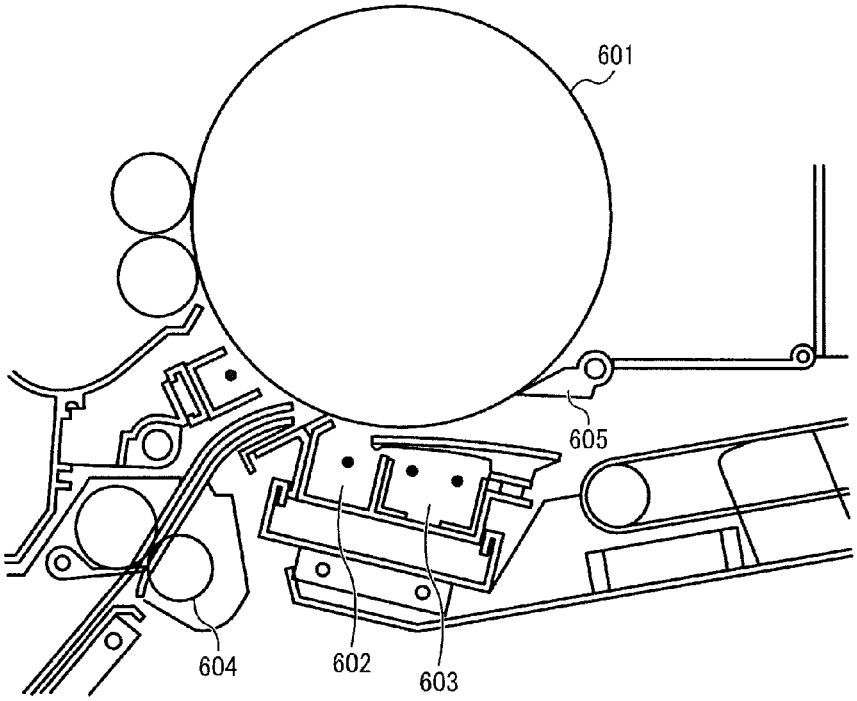
FIG. 36 is a schematic diagram illustrating an image forming apparatus using a transfer charger.

FIG. 36 shows a charger serving as a contact-free transfer device. According to the present illustrative embodiment, a transfer charger 602 is disposed near a photosensitive drum 601, and transfers a toner image on the photosensitive drum 601 onto the recording medium. A bias is applied to a wire of the transfer charger 602. The recording medium fed from a pair of registration rollers 604 passes through a transfer portion at which the transfer charger 602 is disposed and a sheet separation portion at which a separation charger 603 is disposed. A reference number 605 indicates a separation claw.

Figure 37:
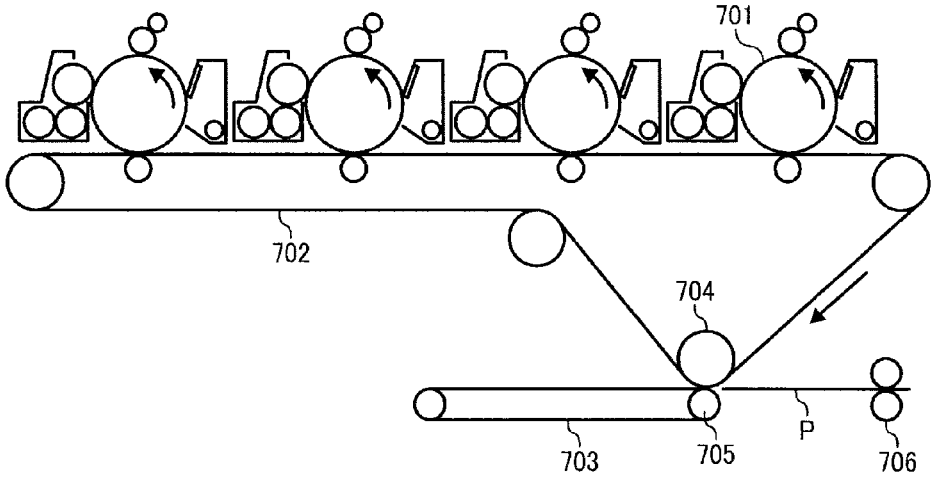
FIG. 37 is a schematic diagram illustrating an image forming apparatus using a secondary transfer conveyance belt.

In FIG. 37, a secondary transfer conveyance belt 703 contacts a belt-type intermediate transfer member (hereinafter, intermediate transfer belt) 702, thereby forming a transfer nip therebetween. A toner image is transferred onto a recording medium P in the transfer nip, and subsequently, the recording medium P is transported to a fixing device by the secondary transfer conveyance belt 703. After the recording medium P is fed by a pair of registration rollers 706, the recording medium P passes through the transfer nip between the intermediate transfer belt 702 and the secondary transfer conveyance belt 703.

As the recording medium P passes through the transfer nip, the toner image is transferred onto the recording medium P. Subsequently, the recording medium P bearing the toner image is separated from the intermediate transfer belt 702 and delivered to the fixing device (not illustrated) by the secondary transfer conveyance belt 703.

According to the present illustrative embodiment, a first roller 704 disposed inside the loop formed by the intermediate transfer belt 702 may serve as a bias application roller to which a bias having a polarity opposite that of the charged toner (normal charging polarity) is applied. This is known as a repulsive force transfer method. Alternatively, a second roller 705 disposed opposite the first roller 704 via the secondary transfer conveyance belt 702 may serve as a bias application roller to which a bias having the same polarity as the toner (normal charging polarity) is applied. This is known as an attraction transfer method.

Furthermore, similar to the configuration shown in FIG. 35, the transfer bias roller and/or the bias application brush may be disposed inside the loop formed by the secondary transfer conveyance belt 703, and the transfer bias is applied to the transfer bias roller and/or the bias application brush. In this case, the transfer bias roller and/or the bias application brush may be disposed at the same place as FIG. 35. The transfer roller (transfer bias roller) may include a foam layer (elastic layer) or a surface layer coated with elastic material such as foam. Alternatively, a transfer charger may be employed.

It is to be noted that the configuration of the transfer portion and the power source are not limited to the configuration described above.

The configuration of the image forming apparatus is not limited to the configuration described above. The order of image forming units arranged in tandem is not limited to the above described order. The present invention may be applicable to an image forming apparatus using toners in four different colors or more, or less than four colors. For example, the present invention may be applicable to a multi-color image forming apparatus using two colors of toner and a monochrome image forming apparatus.

According to an aspect of this disclosure, the present invention is employed in the image forming apparatus. The image forming apparatus includes, but is not limited to, a copier, a printer, a facsimile machine, and a multi-functional system.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member that carries a toner image on a surface thereof;

a transfer device that transfers the toner image onto a recording medium; and a transfer bias power source that applies to the transfer device a superimposed transfer bias in which an alternating current (AC) component is superimposed on a direct current (DC) component in a superimposed transfer mode to transfer the toner image onto the recording medium, the superimposed transfer bias having a waveform in which a first polarity and a second polarity switch alternately, the first polarity in a same direction as a charge polarity of toner of the toner image and the second polarity in a direction opposite the first polarity, wherein the superimposed transfer bias has a returning peak with a polarity opposite to the polarity of the DC component, and the superimposed transfer bias is output such that a standard value of each of the DC component and the AC component is multiplied by a respective correction ratio, and the correction ratio of the DC component is different from that of the AC component.

2. The image forming apparatus according to claim 1, wherein the correction ratio of each of the DC component and the AC component is determined in accordance with at least one of a relative temperature and a relative humidity.

3. The image forming apparatus according to claim 1, wherein the correction ratio of each of the DC component and the AC component is determined in accordance with an absolute humidity.

4. The image forming apparatus according to claim 2, wherein when at least one of the temperature and the humidity decreases, the correction ratio of each of the DC component and the AC component is increased, and when at least one of the temperature and the humidity increases, the correction ratio of each of the DC component and the AC component is reduced.

5. The image forming apparatus according to claim 4, wherein when at least one of the temperature and the humidity either decreases or increases, an amount of change in the correction ratio of the AC component is greater than that of the DC component.

6. The image forming apparatus according to claim 1, wherein the correction ratio of each of the DC component and the AC component is determined in accordance with a printing speed of the image forming apparatus.

7. The image forming apparatus according to claim 6, wherein the correction ratio of the AC component is constant, and when the printing speed decreases, only the correction ratio of the DC component is reduced.

8. The image forming apparatus according to claim 1, wherein the correction ratio of each of the DC component and the AC component is determined in accordance with a width of the recording medium in a main scanning direction.

9. The image forming apparatus according to claim 8, wherein the correction ratio of the AC component is constant, and when the width of the recording medium decreases, only the correction ratio of the DC component is increased.

10. The image forming apparatus according to claim 1, wherein the correction ratio of each of the DC component and the AC component is determined in accordance with a thickness of the recording medium.

11. The image forming apparatus according to claim 10, wherein the correction ratio of the AC component is constant, and when the thickness of the recording medium increases, only the correction ratio of the DC component is increased.

12. The image forming apparatus according to claim 10, wherein the amount of change in the correction ratio of the AC component in a case in which when the recording medium is relatively thick and the resistance of the transfer device is relatively high is less than the amount of change in the correction ratio of the AC component when the recording medium is relatively thin and the resistance of the transfer device is relatively high.

13. The image forming apparatus according to claim 1, wherein the correction ratio of each of the DC component and the AC component is determined in accordance with a resistance of the transfer device.

14. The image forming apparatus according to claim 13, wherein when the resistance of the transfer device increases, the correction ratio of the AC component is increased and the correction ratio of the DC component is reduced.

15. The image forming apparatus according to claim 13, wherein when the resistance of the transfer device increases, the amount of change in the correction ratio of the DC component is greater than that of the AC component.

16. The image forming apparatus according to claim 1, wherein when the recording medium has a relatively rough surface, the toner image is transferred in the superimposed transfer mode.

17. The image forming apparatus according to claim 1, wherein the transfer bias power source alternately applies to the transfer device a DC transfer bias and the superimposed bias, the DC transfer bias including a DC voltage in a DC transfer mode to transfer the toner image.

18. An image forming apparatus, comprising:

an image bearing member;

a transfer member that forms a transfer nip between the image bearing member and the transfer member; and a power source that outputs a superimposed bias in which an alternating current component is superimposed on a direct current component to transfer a toner image from the image bearing member to a sheet at the transfer nip, wherein a peak-to-peak voltage of the superimposed bias is increased when at least one of a temperature and a humidity decreases.

19. The image forming apparatus according to claim 18, wherein a time-averaged value of the superimposed bias increases when at least one of the temperature and the humidity decreases.

20. The image forming apparatus according to claim 19, wherein an alternating current increase ratio of the peak-to-peak voltage is larger than a direct current increase ratio of the time-averaged value when at least one of the temperature and the humidity decreases, the alternating current increase ratio is a correction ratio of the alternating current component, and the direct current increase ratio is a correction ratio of the direct current component.

21. The image forming apparatus according to claim 18, wherein a polarity of the superimposed bias is alternately switched between a positive polarity and a negative polarity.

22. The image forming apparatus according to claim 21, wherein the power source, when operating in a direct-current transfer mode, outputs a direct current bias, and the power source, when operating in a superimposed transfer mode, outputs the superimposed bias.

23. An image forming apparatus, comprising:

an image bearing member;

a transfer device that forms a transfer portion; and a power source that outputs a superimposed bias in which an alternating current component is superimposed on a direct current component to the transfer portion to transfer a toner image from the image bearing member to a sheet, wherein a peak-to-peak voltage of the superimposed bias is changed in accordance with a resistance of the transfer portion.

24. The image forming apparatus according to claim 23, wherein the peak-to-peak voltage of the superimposed bias is increased when the resistance of the transfer portion increases.

25. The image forming apparatus according to claim 24, wherein a time-averaged value of the superimposed bias decreases when the resistance of the transfer portion increases.

26. The image forming apparatus according to claim 25, wherein a direct current decrease ratio of the time-averaged value is larger than an alternating current increase ratio of the peak-to-peak voltage when the resistance of the transfer portion increases, the direct current decrease ratio is a correction ratio of the direct current component, and alternating current increase ratio is a correction ratio of the alternating current component.

27. The image forming apparatus according to claim 23, wherein a time-averaged value of the superimposed bias decreases when the resistance of the transfer portion increases.

28. The image forming apparatus according to claim 23, wherein a polarity of the superimposed bias is alternately switched between a positive polarity and a negative polarity.

29. The image forming apparatus according to claim 28, wherein the power source, when operating in a direct-current transfer mode, outputs a direct current bias, and the power source, when operating in a superimposed transfer mode, outputs the superimposed bias.

* * * * *